US008031138B2

(12) United States Patent
Kim et al.

(10) Patent No.: US 8,031,138 B2
(45) **Date of Patent: *Oct. 4, 2011**

(54) PLASMA DISPLAY PANEL AND PLASMA DISPLAY APPARATUS

(75) Inventors: Heekwon Kim, Gumi (KR); Woochan Cho, Gumi (KR); Yoonseok Kwak, Gumi (KR); Byunghyun Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 931 days.

This patent is subject to a terminal disclaimer.

(21) Appl. No.: 11/931,876

(22) Filed: Oct. 31, 2007

(65) Prior Publication Data

US 2009/0009079 A1 Jan. 8, 2009

(30) Foreign Application Priority Data

Jul. 5, 2007 (KR) ..... 10-2007-0067440

(51) Int. Cl.
*G09G 3/28* (2006.01)

(52) U.S. Cl. ..... 345/60; 345/62; 345/66; 345/67; 345/68; 315/169.4

(58) Field of Classification Search ..... 345/60, 345/61–63, 66–68; 315/169.4
See application file for complete search history.

(56) References Cited

U.S. PATENT DOCUMENTS

| | | | | |
|---|---|---|---|---|
| 5,126,204 | A * | 6/1992 | Tono et al. | 428/403 |
| 2004/0150341 | A1 | 8/2004 | Lee | 313/582 |
| 2005/0110412 | A1* | 5/2005 | Lee | 313/587 |
| 2006/0103307 | A1 | 5/2006 | Yan et al. | 313/582 |
| 2006/0103600 | A1* | 5/2006 | Chang et al. | 345/67 |
| 2006/0125398 | A1* | 6/2006 | Ahn | 313/583 |
| 2006/0238124 | A1 | 10/2006 | Yoo | 313/584 |
| 2007/0298956 | A1* | 12/2007 | Kwon et al. | 501/49 |

FOREIGN PATENT DOCUMENTS

| | | | |
|---|---|---|---|
| EP | 1 746 624 | A2 | 1/2007 |
| JP | 10-125240 | | 5/1998 |
| JP | 11-035372 | * | 2/1999 |
| JP | 2000323048 | A * | 5/1999 |
| JP | 2000-285809 | A | 10/2000 |
| JP | 2003-092086 | A | 3/2003 |
| JP | 2004-207047 | | 7/2004 |
| KR | 2001-0004289 | A * | 1/2001 |
| KR | 10-2006-0081606 | A | 7/2006 |

OTHER PUBLICATIONS

PCT International Search Report and Written Opinion dated Apr. 15, 2008.

European Search Report dated Jul. 6, 2010 issued in Application No. 07 86 0825.

* cited by examiner

*Primary Examiner* — Lun-Yi Lao
*Assistant Examiner* — Olga Merkoulova
(74) *Attorney, Agent, or Firm* — KED & Associates, LLP

(57) ABSTRACT

A plasma display panel and a plasma display apparatus are disclosed. The plasma display panel includes a front substrate including a scan electrode and a sustain electrode positioned parallel to each other, an upper dielectric layer positioned on the scan and sustain electrodes, a rear substrate on which an address electrode is positioned to intersect the scan and sustain electrodes, a lower dielectric layer positioned on the address electrode, a barrier rib positioned between the front substrate and the rear substrate to partition a discharge cell, and a phosphor layer positioned inside the discharge cell. The upper dielectric layer includes a glass-based material and a blue pigment. The phosphor layer includes a phosphor material and MgO material.

20 Claims, 19 Drawing Sheets

FIG. 3

| Glass-based material | Blue pigment |
|---|---|
| $PbO-B_2O_3-SiO_2$-based glass material | Co-based material |
| $P_2O_6-B_2O_3-ZnO$-based glass material | |
| $ZnO-B_2O_3-RO$-based glass material where RO is any one of BaO, SrO, $La_2O_3$ $Bi_2O_3$, $P_2O_3$, and SnO $ZnO-BaO-RO$ -based glass material | |
| $ZnO-BaO-RO$-based glass material where RO is any one of SrO, $La_2O_3$ $Bi_2O_3$, $P_2O_3$, and SnO $ZnO-Bi_2O_3-RO$ -based glass material | |
| $ZnO-Bi_2O_3-RO$-based glass material where RO is any one of SrO, $La_2O_3$ $P_2O_3$, and SnO | |

| | Comparative example | Experimental example 1 | Experimental example 2 | Experimental example 3 |
|---|---|---|---|---|
| Firing voltage | 135V | 128V | 129V | 127V |
| Luminance | 171 (cd/m$^2$) | 176 (cd/m$^2$) | 177 (cd/m$^2$) | 179 (cd/m$^2$) |
| Bright room CR (25%) | 54:1 | 62:1 | 60:1 | 64:1 |

FIG. 7

| M/T | A-type panel | | B-type panel |
|---|---|---|---|
| | Contrast characteristic | Luminance | Luminance |
| 0.00005 | ◎ | X | ○ |
| 0.0001 | ◎ | ○ | ◎ |
| 0.000125 | ◎ | ◎ | ◎ |
| 0.0002 | ◎ | ◎ | ◎ |
| 0.0005 | ◎ | ◎ | ◎ |
| 0.0012 | ◎ | ◎ | ◎ |
| 0.004 | ◎ | ◎ | ◎ |
| 0.009 | ◎ | ◎ | ◎ |
| 0.013 | ◎ | ◎ | ◎ |
| 0.027 | ◎ | ◎ | ◎ |
| 0.031 | ◎ | ◎ | ◎ |
| 0.034 | ◎ | ◎ | ◎ |
| 0.039 | ○ | ◎ | ◎ |
| 0.04 | ○ | ◎ | ◎ |
| 0.05 | X | ◎ | ○ |
| 0.06 | X | ◎ | X |

FIG. 8

| M/T | A-type panel | | B-type panel |
|---|---|---|---|
| | Contrast characteristic | Luminance | Luminance |
| 0.002 | ◎ | X | X |
| 0.0055 | ◎ | X | ○ |
| 0.006 | ◎ | X | ○ |
| 0.0083 | ◎ | ○ | ○ |
| 0.0141 | ◎ | ○ | ◎ |
| 0.0169 | ◎ | ◎ | ◎ |
| 0.032 | ◎ | ◎ | ◎ |
| 0.067 | ◎ | ◎ | ◎ |
| 0.091 | ◎ | ◎ | ◎ |
| 0.13 | ◎ | ◎ | ◎ |
| 0.69 | ◎ | ◎ | ◎ |
| 1.2 | ◎ | ◎ | ◎ |
| 2.4 | ◎ | ◎ | ◎ |
| 4.8 | ◎ | ◎ | ◎ |
| 6.1 | ◎ | ◎ | ◎ |
| 6.7 | ◎ | ◎ | ◎ |
| 8.0 | ◎ | ◎ | ○ |
| 9.3 | ○ | ◎ | ○ |
| 10.0 | ○ | ◎ | ○ |
| 12.0 | X | ◎ | X |

FIG. 9

| T/C | A-type panel | | B-type panel | |
|---|---|---|---|---|
| | Contrast characteristic | Luminance | Contrast characteristic | Luminance |
| 10 | ◎ | X | X | ◎ |
| 30 | ◎ | X | ○ | ◎ |
| 40 | ◎ | ○ | ○ | ◎ |
| 60 | ◎ | ○ | ○ | ◎ |
| 80 | ◎ | ○ | ◎ | ◎ |
| 110 | ◎ | ◎ | ◎ | ◎ |
| 140 | ◎ | ◎ | ◎ | ◎ |
| 170 | ◎ | ◎ | ◎ | ◎ |
| 210 | ◎ | ◎ | ◎ | ◎ |
| 260 | ◎ | ◎ | ◎ | ◎ |
| 290 | ◎ | ◎ | ◎ | ○ |
| 330 | ◎ | ◎ | ◎ | ○ |
| 390 | ○ | ◎ | ◎ | ○ |
| 420 | ○ | ◎ | ◎ | ○ |
| 480 | ○ | ◎ | ◎ | X |
| 500 | X | ◎ | ◎ | X |

| Content of Co-based material (parts by weight) | Dark room C/R(1%) | Bright room C/R(25%) | Reflectance (%) | Color temperature (K) |
|---|---|---|---|---|
| 0 | 9920:1 | 52:1 | 35 | 7100 |
| 0.05 | 9950:1 | 53:1 | 34 | 7200 |
| 0.1 | 10900:1 | 60:1 | 31 | 7500 |
| 0.15 | 11500:1 | 62:1 | 29 | 8050 |
| 0.2 | 11955:1 | 65:1 | 26.4 | 8270 |
| 0.3 | 12160:1 | 67:1 | 25.2 | 8400 |
| 0.5 | 12700:1 | 68:1 | 24 | 8500 |
| 0.6 | 13200:1 | 69:1 | 23 | 8600 |
| 0.7 | 14000:1 | 70:1 | 22.5 | 8900 |
| 1.0 | 14200:1 | 72:1 | 21 | 9100 |

PLASMA DISPLAY PANEL AND PLASMA DISPLAY APPARATUS

This application claims the benefit of Korean Patent Application No. 10-2007-0067440 filed on Jul. 5, 2007 which is hereby incorporated by reference.

BACKGROUND OF THE DISCLOSURE

1. Field of the Disclosure

This document relates to a plasma display panel and a plasma display apparatus.

2. Description of the Related Art

A plasma display apparatus includes a plasma display panel.

The plasma display panel includes a phosphor layer inside discharge cells partitioned by barrier ribs and a plurality of electrodes.

A driving signal is supplied to the electrodes, thereby generating a discharge inside the discharge cells. When the driving signal generates a discharge inside the discharge cells, a discharge gas filled inside the discharge cells generates vacuum ultraviolet rays, which thereby cause phosphors formed inside the discharge cells to emit light, thus displaying an image on the screen of the plasma display panel.

SUMMARY OF THE DISCLOSURE

In one aspect, a plasma display panel comprises a front substrate including a scan electrode and a sustain electrode positioned parallel to each other, an upper dielectric layer positioned on the scan electrode and the sustain electrodes the upper dielectric layer including a glass-based material and a blue pigment, a rear substrate on which an address electrode is positioned to intersect the scan electrode and the sustain electrode, a lower dielectric layer positioned on the address electrode, a barrier rib that is positioned between the front substrate and the rear substrate and partitions a discharge cell, and a phosphor layer positioned inside the discharge cell, the phosphor layer including a phosphor material and magnesium oxide (MgO) material.

In another aspect, a plasma display panel comprises a front substrate including a scan electrode and a sustain electrode positioned parallel to each other, an upper dielectric layer positioned on the scan electrode and the sustain electrode, the upper dielectric layer including a glass-based material and a blue pigment, a rear substrate on which an address electrode is positioned to intersect the scan electrode and the sustain electrode, a lower dielectric layer positioned on the address electrode, a barrier rib that is positioned between the front substrate and the rear substrate and partitions a discharge cell, and a phosphor layer positioned inside the discharge cell, the phosphor layer including a phosphor material and magnesium oxide (MgO) material, wherein a ratio of a content of MgO material to a thickness of the upper dielectric layer ranges from 0.0001 to 0.04.

In still another aspect, a plasma display panel comprises a front substrate including a scan electrode and a sustain electrode positioned parallel to each other, an upper dielectric layer positioned on the scan electrode and the sustain electrode, the upper dielectric layer including a glass-based material and a blue pigment, a rear substrate on which an address electrode is positioned to intersect the scan electrode and the sustain electrode, a lower dielectric layer positioned on the address electrode, a barrier rib that is positioned between the front substrate and the rear substrate and partitions a discharge cell, and a phosphor layer positioned inside the discharge cell, the phosphor layer including a phosphor material and magnesium oxide (MgO) material, wherein a ratio of a thickness of the upper dielectric layer to a content of blue pigment ranges from 40 to 420.

In yet still another aspect, a plasma display apparatus comprises a front substrate including a scan electrode and a sustain electrode positioned parallel to each other, an upper dielectric layer positioned on the scan electrode and the sustain electrode, the upper dielectric layer including a glass-based material and a blue pigment, a rear substrate on which an address electrode is positioned to intersect the scan electrode and the sustain electrode, a lower dielectric layer positioned on the address electrode, a barrier rib that is positioned between the front substrate and the rear substrate and partitions a discharge cell, and a phosphor layer positioned inside the discharge cell, the phosphor layer including a phosphor material and magnesium oxide (MgO) material, wherein a first sustain signal is supplied to the scan electrode and a second sustain signal overlapping the first sustain signal is supplied to the sustain electrode during a sustain period of at least one subfield of a frame.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIG. 3 illustrates a composition of an upper dielectric layer;

FIG. 7 is a table showing a relationship between a content of oxide material and a thickness of an upper dielectric layer;

FIG. 8 is a table showing a relationship between a content of oxide material and a content of blue pigment;

FIG. 9 is a table showing a relationship between a content of blue pigment and a thickness of an upper dielectric layer;

DETAILED DESCRIPTION OF EMBODIMENTS

Reference will now be made in detail embodiments of the invention examples of which are illustrated in the accompanying drawings.

Figure 1A:
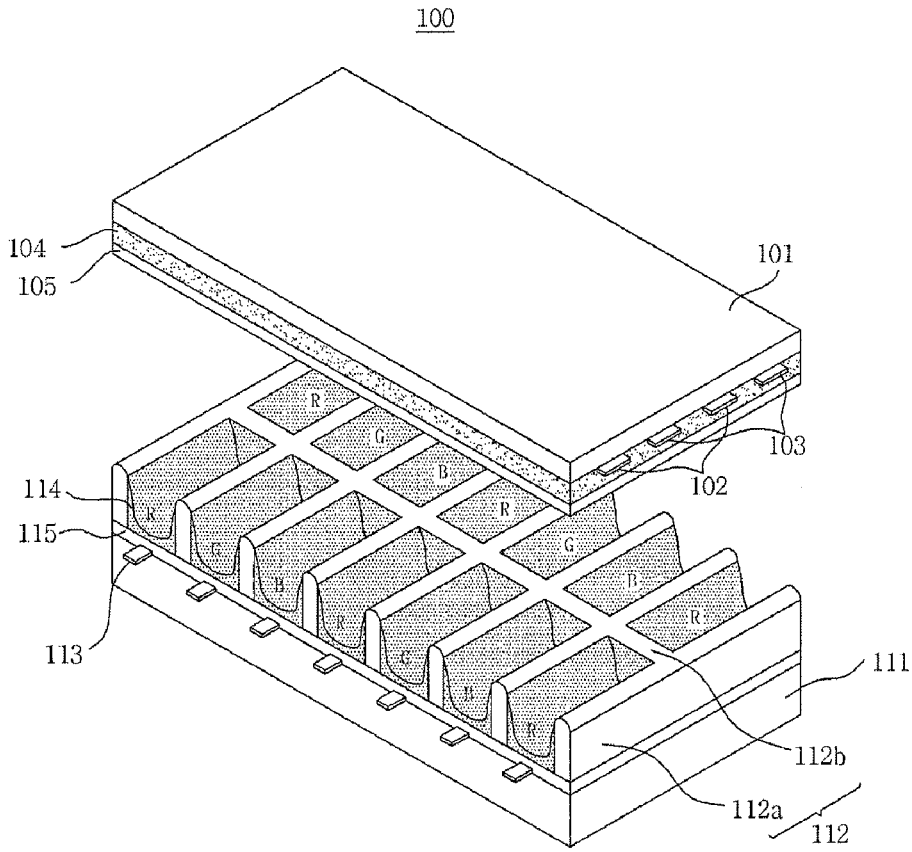
FIGS. 1A and 1B illustrate a structure of a plasma display panel according to an exemplary embodiment.
Figure 1B:
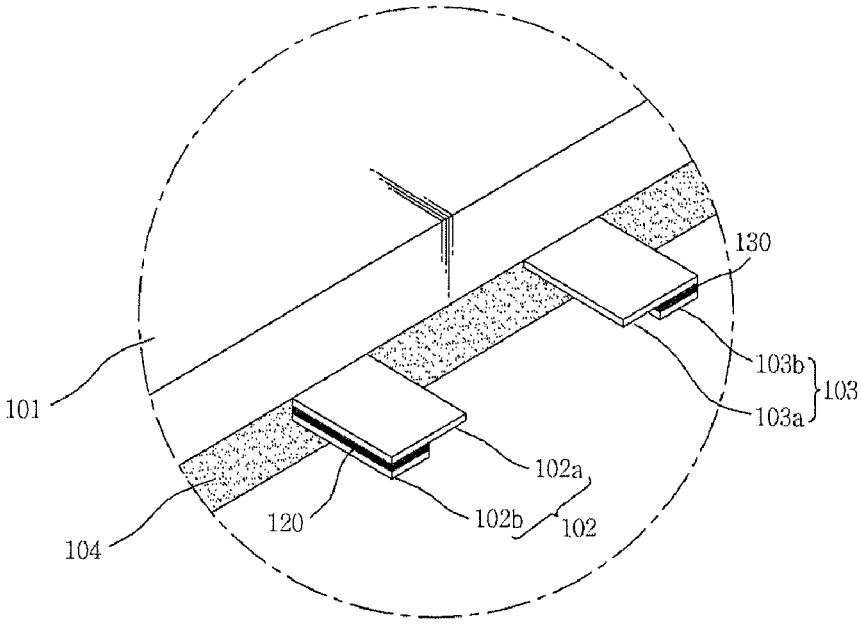

FIGS. 1A and 1B illustrate a structure of a plasma display panel according to an exemplary embodiment.

As illustrated in FIG. 1A, a plasma display panel 100 according to an exemplary embodiment includes a front substrate 101 and a rear substrate 111 which coalesce with each other. On the front substrate 101, a scan electrode 102 and a sustain electrode 103 are positioned parallel to each other. On the rear substrate 111, an address electrode 113 is positioned to intersect the scan electrode 102 and the sustain electrode 103.

An upper dielectric layer 104 is positioned on the scan electrode 102 and the sustain electrode 103 to provide electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 is positioned on the address electrode 113 to provide electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell, and a blue (B) discharge cell, and the like, may be positioned between the front substrate 101 and the rear substrate 111. In addition to the red (R), green (G), and blue (B) discharge cells, a white (W) discharge cell or a yellow (Y) discharge cell may be positioned.

Each discharge cell partitioned by the barrier ribs 112 is filled with a discharge gas including xenon (Xe), neon (Ne), and so forth.

A phosphor layer 114 is positioned inside the discharge cells to emit visible light for an image display during the generation of an address discharge. For instance, first, second and third phosphor layer respectively emitting red (R), blue (B) and green (G) light may be positioned inside the discharge cells. In addition to the red (R), green (G) and blue (B) light, a phosphor layer emitting white or yellow light may be positioned.

A thickness of at least one of the phosphor layers 114 formed inside the red (R), green (G) and blue (B) discharge cells may be different from thicknesses of the other phosphor layers. For instance, thicknesses of the second and third phosphor layers inside the blue (B) and green (G) discharge cells may be larger than a thickness of the first phosphor layer inside the red (R) discharge cell. The thickness of the second phosphor layer may be substantially equal or different from the thickness of the third phosphor layer.

Widths of the red (R), green (G), and blue (B) discharge cells may be substantially equal to one another. Further, a width of at least one of the red (R), green (G), or blue (B) discharge cells may be different from widths of the other discharge cells. For instance, a width of the red (R) discharge cell may be the smallest, and widths of the green (G) and blue (B) discharge cells may be larger than the width of the red (R) discharge cell. The width of the green (G) discharge cell may be substantially equal or different from the width of the blue (B) discharge cell. Hence, a color temperature of an image displayed on the plasma display panel can be improved.

The plasma display panel 100 may have various forms of barrier rib structures as well as a structure of the barrier rib 112 illustrated in FIG. 1A. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1A has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1A has illustrated and described the case where the barrier rib 112 is formed on the rear substrate 111, the barrier rib 112 may be formed on at least one of the front substrate 101 or the rear substrate 111.

In FIG. 1A, the upper dielectric layer 104 and the lower dielectric layer 115 each have a single-layered structure. However, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

FIG. 1B illustrates another structure of the scan electrode 102 and the sustain electrode 103.

The scan electrode 102 and the sustain electrode 103 may have a multi-layered structure, respectively. For instance, the scan electrode 102 and the sustain electrode 103 each include transparent electrodes 102*a* and 103*a* and bus electrodes 102*b* and 103*b*.

The bus electrodes 102*b* and 103*b* may include a substantially opaque material, for instance, at least one of silver (Ag), gold (Au), or aluminum (Al). The transparent electrodes 102*a* and 103*a* may include a substantially transparent material, for instance, indium-tin-oxide (ITO).

Black layers 120 and 130 are formed between the transparent electrodes 102*a* and 103*a* and the bus electrodes 102*b* and 103*b* to prevent the reflection of external light caused by the bus electrodes 102*b* and 103*b*.

The transparent electrodes 102*a* and 103*a* may be omitted from the scan electrode 102 and the sustain electrode 103. In other words, the scan electrode 102 and the sustain electrode 103 may be called an ITO-less electrode in which the transparent electrodes 102*a* and 103*a* are omitted.

Figure 2:
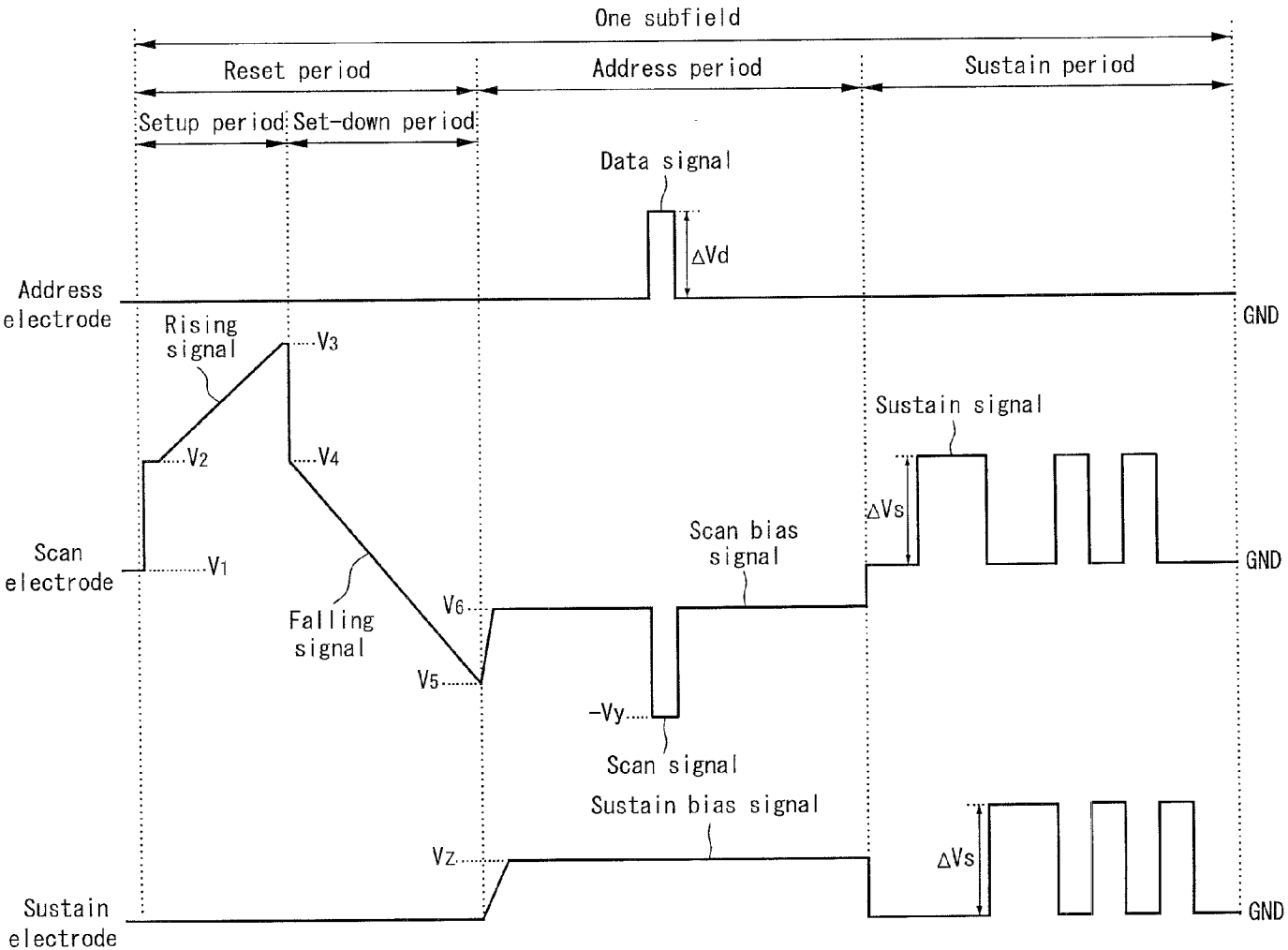
FIG. 2 illustrates an operation of the plasma display panel according to the exemplary embodiment.

FIG. 2 illustrates an operation of the plasma display panel according to the exemplary embodiment. The exemplary embodiment is not limited to FIG. 2, and an operation method of the plasma display can be variously changed.

As illustrated in FIG. 2, during a reset period for initialization of wall charges, a reset signal is supplied to the scan electrode. The reset signal includes a rising signal and a falling signal. The reset period is further divided into a setup period and a set-down period.

During the setup period, the rising signal with a gradually rising voltage is supplied to the scan electrode. The rising signal generates a weak dark discharge (i.e., a setup discharge) inside the discharge cell during the setup period, thereby accumulating a proper amount of wall charges inside the discharge cell.

During the set-down period, a falling signal of a polarity direction opposite a polarity direction of the rising signal is supplied to the scan electrode. The falling signal generates a weak erase discharge (i.e., a set-down discharge) inside the discharge cell. Furthermore, the remaining wall charges are uniform inside the discharge cells to the extent that an address discharge can be stably performed.

During an address period following the reset period, a scan bias signal, which is maintained at a sixth voltage V6 higher than a lowest voltage of the falling signal, is supplied to the scan electrode.

A scan signal falling from the scan bias signal is supplied to the scan electrode.

A width of a scan signal supplied during an address period of at least one subfield may be different from a width of a scan signal supplied during address periods of the other subfields. For instance, a width of a scan signal in a subfield may be larger than a width of a scan signal in the next subfield in time order. Further, a width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, . . . , 1.9 μs, 1.9 μs, etc.

As above, when the scan signal is supplied to the scan electrode, a data signal corresponding to the scan signal is supplied to the address electrode.

As the voltage difference between the scan signal and the data signal is added to the wall voltage generated during the reset period, the address discharge occurs within the discharge cell to which the data signal is supplied.

A sustain bias signal is supplied to the sustain electrode during the address period to prevent the generation of the unstable address discharge by interference of the sustain electrode Z.

The sustain bias signal is substantially maintained at a sustain bias voltage Vz. The sustain bias voltage Vz is lower than a voltage Vs of a sustain signal and is higher than the ground level voltage GND.

During a sustain period following the address period, a sustain signal is alternately supplied to the scan electrode and the sustain electrode.

As the wall voltage within the discharge cell selected by performing the address discharge is added to the sustain voltage Vs of the sustain signal, every time the sustain signal is supplied, the sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can be more stable.

FIG. 3 illustrates a composition of an upper dielectric layer.

As illustrated in FIG. 3, an upper dielectric layer includes a glass-based material and a blue pigment, and has a blue-based color due to the blue pigment.

The glass-based material is not particularly limited. The glass-based material may be any one of PbO—$B_2O_3$—$SiO_2$-based glass material, $P_2O_6$—$B_2O_3$—ZnO-based glass material, ZnO—$B_2O_3$—RO-based glass material (where RO is any one of BaO, SrO, $La_2O_3$, $Bi_2O_3$, $P_2O_3$ and SnO), ZnO—BaO—RO-based glass material (where RO is any one of SrO, $La_2O_3$, $Bi_2O_3$, $P_2O_3$ and SnO), and ZnO—$Bi_2O_3$—RO-based glass material (where RO is any one of SrO, $La_2O_3$, $P_2O_3$ and SnO), or a mixture of at least two of the above glass-based materials.

The blue pigment included in the upper dielectric layer is not particularly limited except that the upper dielectric layer has a blue-based color. The blue pigment may include at least one of a cobalt (Co)-based material, a copper (Cu)-based material, a chrome (Cr)-based material, a nickel (Ni)-based material, an aluminum (Al)-based material, a titanium (Ti)-based material, a cerium (Ce)-based material, a manganese (Mn)-based material or a neodymium (Nd)-based material, in consideration of the facility of powder manufacture, the color, and the manufacturing cost.

An example of a method of manufacturing the upper dielectric layer is as follows.

First, a glass-based material and a blue pigment are mixed. For instance, $P_2O_6$—$B_2O_3$—ZnO-based glass material and the blue pigment are mixed.

A glass is manufactured using the glass-based material mixed with the blue pigment. In this case, a blue glass having a blue-based color due to the blue pigment is manufactured.

The manufactured blue glass is grinded to manufacture a blue glass powder. The particle size of the blue glass powder may range from about 0.1 μm to 10 μm.

The blue glass powder is mixed with a binder, a solvent, and the like, to manufacture a dielectric paste. An additive such as a dispersion stabilizer may be added to the dielectric paste.

The dielectric paste is coated on the front substrate on which the scan electrode and the sustain electrode are formed. Then, the coated dielectric paste is dried and fired to form the upper dielectric layer.

Accordingly, the upper dielectric layer manufactured using the above manufacturing method can have a blue-based color.

Since the above description is only one example of the manufacturing method of the upper dielectric layer, the exemplary embodiment is not limited thereto. For instance, the upper dielectric layer may be manufactured using a laminating method.

Figure 4:
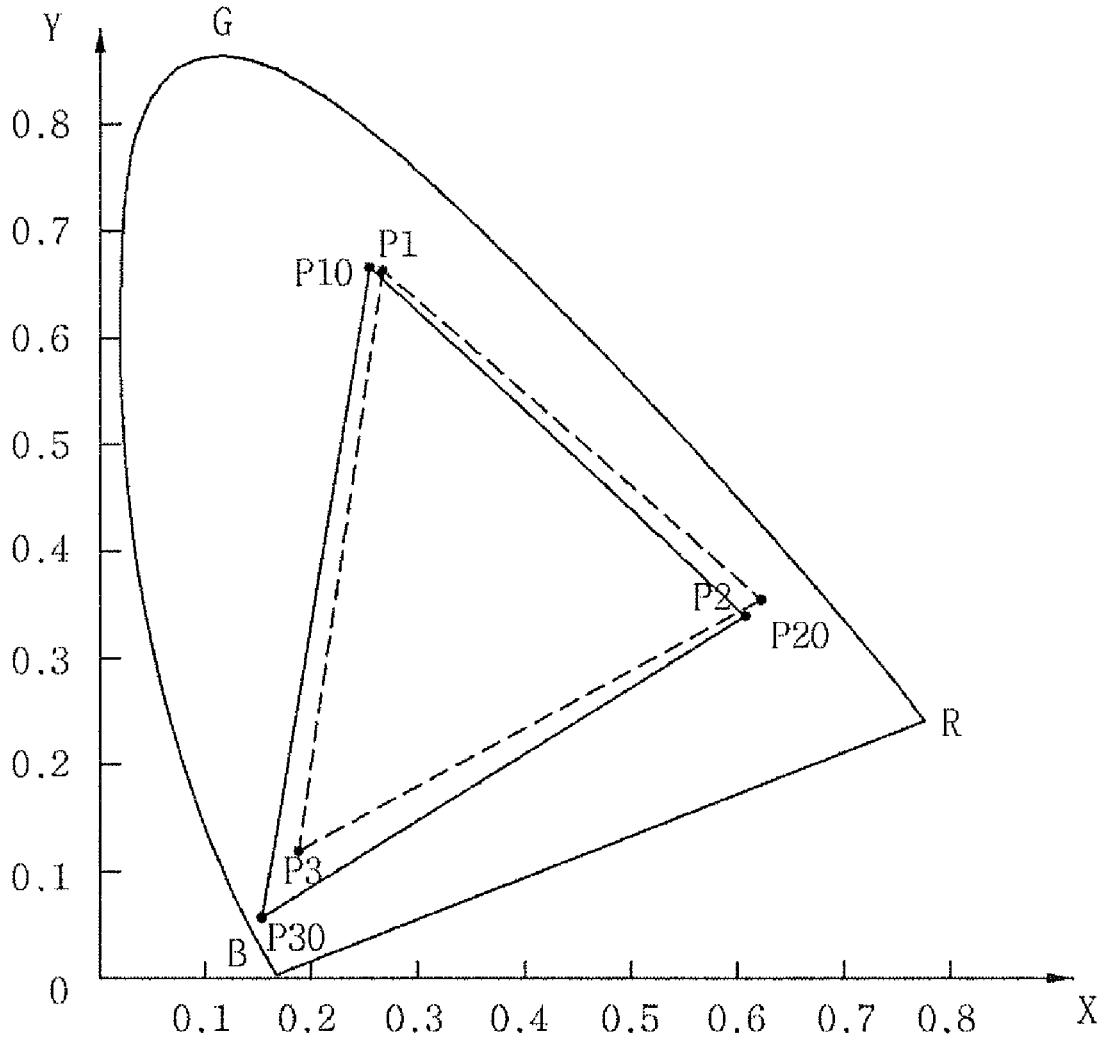
FIG. 4 is a graph showing color coordinates of the plasma display panel according to the exemplary embodiment.

FIG. 4 is a graph showing color coordinates of the plasma display panel according to the exemplary embodiment.

A 1-typed panel in which an upper dielectric layer includes a glass-based material and a Co-based material of 0.2 part by weight as a blue pigment and a 2-typed panel in which an upper dielectric layer includes a glass-based material and does not include a pigment are manufactured. Then, color coordinates are measured using a photodetector (MCPD-1000) in a state where the same driving signal is supplied to the 1-typed and 2-typed panels.

As illustrated in FIG. 4, in the 2-typed panel, a green coordinate P1 has X-axis coordinate of about 0.272 and Y-axis coordinate of about 0.672; a red coordinate P2 has X-axis coordinate of about 0.630 and Y-axis coordinate of about 0.357; and a blue coordinate P3 has X-axis coordinate of about 0.190 and Y-axis coordinate of about 0.115.

In the 1-typed panel, a green coordinate P10 has X-axis coordinate of about 0.270 and Y-axis coordinate of about 0.670; a red coordinate P20 has X-axis coordinate of about 0.600 and Y-axis coordinate of about 0.340; and a blue coordinate P30 has X-axis coordinate of about 0.155 and Y-axis coordinate of about 0.060.

It can be seen from FIG. 4 that a triangle formed by connecting the coordinates P10, P20 and P30 of the 1-typed panel leans toward a blue direction as compared with a triangle formed by connecting the coordinates P1, P2 and P3 of the 2-typed panel. This means that a color temperature of the 1-typed panel is higher than a color temperature of the 2-typed panel. Hence, a viewer may think that an image displayed on the 1-typed panel is clearer than an image displayed on the 2-typed panel.

As above, when the upper dielectric layer has a blue-based color by including the blue pigment such as the Co-based material, a color temperature can be improved. Further, because the upper dielectric layer absorbs incident light, a panel reflectance can be reduced and a contrast characteristic can be improved.

Figures 5, 6A:
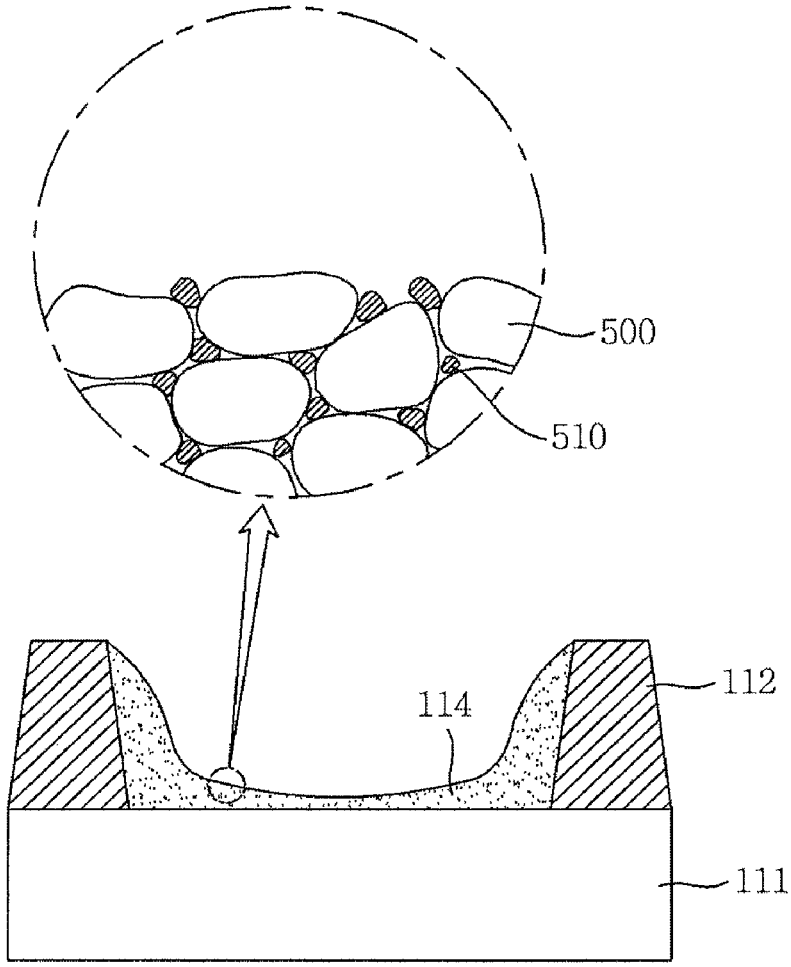
FIG. 5 is a diagram for explaining a phosphor layer.
FIGS. 6A and 6B are diagrams for explaining a reason why a phosphor layer includes an oxide material.

FIG. 5 is a diagram for explaining a phosphor layer.

As illustrated in FIG. 5, the phosphor layer 114 includes a phosphor material 500 and an oxide material 510.

The phosphor layer 114 may include a first phosphor layer emitting red light, a second phosphor layer emitting blue light and a third phosphor layer emitting green light.

The first phosphor layer may include a first phosphor material and an oxide material, the second phosphor layer may include a second phosphor material and an oxide material, and the third phosphor layer may include a third phosphor material and an oxide material.

The first phosphor material is not particularly limited except the red light emission. The first phosphor material may include (Y, Gd)BO:Eu in consideration of an emitting efficiency of red light.

The second phosphor material is not particularly limited except the blue light emission. The second phosphor material may include (Ba, Sr, Eu)$MgAl_{10}O_{17}$ in consideration of an emitting efficiency of blue light.

The third phosphor material is not particularly limited except the green light emission. The third phosphor material may include $Zn_2SiO_4$:$Mn^{+2}$ and $YBO_3$:$Tb^{+3}$ in consideration of an emitting efficiency of green light.

The oxide material can improve a discharge response characteristic between the scan electrode and the address electrode or between the sustain electrode and the address electrode.

The oxide material is not particularly limited except the improvement of the discharge response characteristic between the scan electrode and the address electrode or between the sustain electrode and the address electrode. For instance, the oxide material may include at least one of MgO material, ZnO material, SiO2 material, TiO2 material, Y2O3 material, Al2O3 material, La2O3 material, Fe2O3 material, EuO material, or CoO material. The oxide material may be the MgO material.

The reason why the phosphor layer 114 includes the phosphor material 500 and the oxide material 510 is as follows.

When the upper dielectric layer includes the blue pigment such as the Co-based material, a panel reflectance is reduced. However, since a panel transmittance is reduced, a luminance is reduced.

On the contrary, when the phosphor layer 114 includes the oxide material such as the MgO material, the MgO material having a high secondary electron emission coefficient acts as a catalyst of a discharge. Hence, a firing voltage between the scan electrode and the address electrode or between the sustain electrode and the address electrode can be lowered. Further, because an intensity of a discharge generated at an equal voltage becomes strong, the luminance further increase. Although the upper dielectric layer includes the blue pigment such as the Co-based material, the MgO material can prevent a reduction in the luminance and can improve the contrast characteristic by reducing the panel reflectance.

Figure 6B:
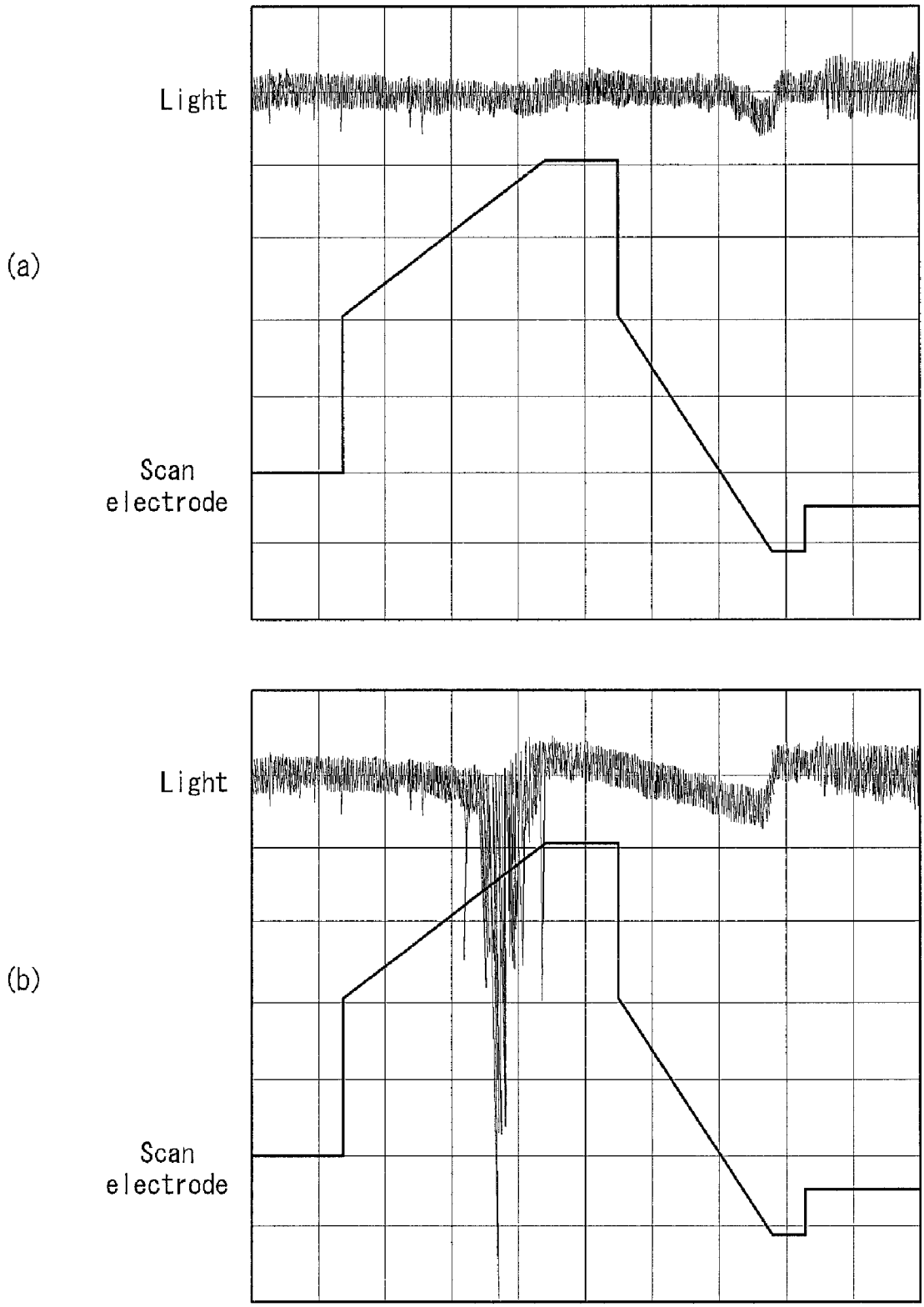

FIGS. 6A and 6B are diagrams for explaining a reason why a phosphor layer includes an oxide material.

FIG. 6A is a table showing a firing voltage, a luminance and a bright room contrast ratio (CR) of each of a comparative example and experimental examples 1, 2 and 3. The bright room contrast ratio measures a contrast ratio in a state where an image with a window pattern corresponding to 25% of the screen size is displayed in a bright room. The firing voltage is a firing voltage measured between the scan electrode and the address electrode.

In the comparative example, an upper dielectric layer includes a Co-based material of 0.15 part by weight and a phosphor layer does not include an oxide material.

In the experimental example 1, an upper dielectric layer includes a Co-based material of 0.15 part by weight and a phosphor layer includes MgO material of 0.05 part by weight.

In the experimental example 2, an upper dielectric layer includes a Co-based material of 0.15 part by weight and a phosphor layer includes MgO material of 0.07 part by weight.

In the experimental example 3, an upper dielectric layer includes a Co-based material of 0.15 part by weight and a phosphor layer includes MgO material of 0.1 part by weight.

In the comparative example, the firing voltage is 135V, and the luminance is 171 cd/$m^2$.

In the experimental examples 1, 2 and 3, the firing voltage is 127V to 129V lower than the firing voltage of the comparative example, and the luminance is 176 cd/$m^2$ to 179 cd/$m^2$ higher than the luminance of the comparative example.

While the bright room contrast ratio of the comparative example is 54:1, the bright room contrast ratio of the experimental examples 1, 2 and 3 is 60:1 to 64:1. As could be seen from FIG. 6A, a contrast characteristic of the experimental examples 1, 2 and 3 is larger than that of the comparative example. The reason why the MgO material improves the contrast characteristic will be described below with reference to FIG. 6B.

When a scan signal is supplied to the scan electrode and a data signal is supplied to the address electrode on condition that the phosphor layer does not include the oxide material, wall charges are accumulated on the surface of particles of the phosphor material. Wall charges may be concentratedly accumulated on a specific portion of the phosphor layer due to a nonuniform height of the phosphor layer, thereby generating a relatively strong discharge in the specific portion. Furthermore, a discharge occurs at a relatively high firing voltage.

Accordingly, because a strong discharge occurs instantaneously, the quantity of light can instantaneously increase. Hence, the contrast characteristics may worsen. As illustrated in (b) of FIG. 6B, since a strong discharge sharply occurs between the scan electrode and the address electrode during a reset period, the quantity of light during the reset period can instantaneously increase. Hence, the contrast characteristic may worsen.

Furthermore, since the accumulation amount of wall charges may vary depending on each discharge cell, a discharge may be nonuniform and unstable. As a result, a viewer may watch a noise and the image quality may worsen.

On the contrary, when the phosphor layer includes the oxide material, the oxide material acts as a catalyst of a discharge. Hence, a discharge can stably occur between the scan electrode and the address electrode at a relatively low voltage. For instance, as illustrated in (a) of FIG. 6B, since a discharge stably occurs between the scan electrode and the address electrode during a reset period, the quantity of light during the reset period is stabilized. Hence, the contrast characteristic can be improved. Furthermore, the generation of a noise can be suppressed due to a uniform discharge.

The MgO material included in the phosphor layer may be (111), (222), (444), (100), (200) and (400)-oriented MgO materials.

(111), (222) and (444)-oriented MgO materials having a relatively high secondary electron emission coefficient may be used so as to reduce discharge delay time by improving a discharge characteristic between the scan electrode and the address electrode.

(100), (200) and (400)-oriented MgO materials having an excellent sputter-resistance characteristic may be used so as to suppress a degradation of the phosphor layer.

(111), (222) and (444)-oriented MgO materials and (100), (200) and (400)-oriented MgO materials may be used together so as to suppress a degradation of the phosphor layer and to reduce discharge delay time.

FIG. 7 is a table showing a contrast characteristic and a luminance of a displayed image depending on changes in a ratio of a content of the oxide material to a thickness of the upper dielectric layer. The oxide material uses MgO material.

The thickness of the upper dielectric layer is indicated as T in micrometer (μm), and the content of oxide material is indicated as M in part by weight.

In an A-type panel, when a ratio M/T has a value of 0.00005 to 0.06 by changing the thickness T of the upper dielectric layer in a state where the content (M) of the oxide material is fixed, a contrast characteristic and a luminance of a displayed image are measured.

In a B-type panel, when a ratio M/T has a value of 0.00005 to 0.06 by changing the content (M) of the oxide material in a state where the thickness T of the upper dielectric layer is fixed, a luminance is measured.

In FIG. 7, ◎ indicates that a contrast characteristic and a luminance are excellent, ○ indicates that a contrast characteristic and a luminance are good, and X indicates that a contrast characteristic and a luminance are bad.

In the A-type panel, when the ratio M/T ranges from 0.00005 to 0.034, the contrast characteristic is excellent (◎) because a reflectance of the upper dielectric layer is sufficiently high due to the sufficient thick upper dielectric layer with respect to the content of oxide material.

When the ratio M/T ranges from 0.039 to 0.04, the contrast characteristic is good (○). In this case, the contrast characteristic may be slightly reduced due to a low reflectance of the upper dielectric layer.

When the ratio M/T is equal to or more than 0.05, the contrast characteristic is bad (X) because a reflectance of the upper dielectric layer is excessively low due to the excessively thin upper dielectric layer with respect to the content of oxide material.

When the content of oxide material is 0.01 part by weight and the upper dielectric layer has an excessively small thickness of about 2 μm, the ratio M/T has a value equal to or more than 0.05. In this case, the contrast characteristic may worsen due to an excessively low reflectance of the upper dielectric layer.

In the A-type panel, when the ratio M/T is 0.00005, the luminance is bad (X) because a transmittance of the upper dielectric layer is excessively low due to the excessively thick upper dielectric layer with respect to the content of oxide material.

When the content of oxide material is 0.05 part by weight and the upper dielectric layer has an excessively large thickness of about 1,000 μm, the ratio M/T is 0.00005. In this case, the luminance may worsen due to an excessively low transmittance of the upper dielectric layer.

When the ratio M/T is 0.05, the luminance is good (○). In this case, the luminance may be slightly reduced due to a low transmittance of the upper dielectric layer.

When the ratio M/T is equal to or more than 0.000125, the luminance is excellent (◎) because a transmittance of the upper dielectric layer is sufficiently high due to the sufficiently thin upper dielectric layer with respect to the content of oxide material.

In the B-type panel, when the ratio M/T is 0.00005 and 0.05, the luminance is good (○).

When the ratio M/T ranges from 0.0001 to 0.04, the luminance is excellent (◎) because a firing voltage between the scan electrode and the address electrode or between the sustain electrode and the address electrode is sufficiently low due to a sufficiently large amount of oxide material with respect to the thickness of the upper dielectric layer.

When the ratio M/T is equal to or more than 0.06, the luminance is bad (X). The reason is that particles of the oxide material may cover a considerable portion of the surface of the phosphor particles due to an excessively large amount of oxide material and thus the surface area of the phosphor material exposed to ultraviolet rays decreases.

Considering the description of FIG. 7, the ratio M/T of the content (M) of oxide material to the thickness T of the upper dielectric layer may range from 0.0001 to 0.04. Further, the ratio M/T may range from 0.000125 to 0.034.

FIG. 8 is a table showing a contrast characteristic and a luminance of a displayed image depending on changes in a ratio of a content of oxide material to a content of Co-based material used as a blue pigment. The oxide material uses MgO material.

The content of Co-based material is indicated as C in part by weight, and the content of oxide material is indicated as M in part by weight.

In an A-type panel, when a ratio M/C has a value of 0.002 to 12.0 by changing the content (C) of the Co-based material in a state where the content (M) of the oxide material is fixed, a contrast characteristic and a luminance of a displayed image are measured.

In a B-type panel, when a ratio M/C has a value of 0.002 to 12.0 by changing the content (M) of the oxide material in a state where the content (C) of the Co-based material is fixed, a luminance of a displayed image is measured.

In FIG. 8, ◎ indicates that a contrast characteristic and a luminance are excellent, ○ indicates that a contrast characteristic and a luminance are good, and X indicates that a contrast characteristic and a luminance are bad.

In the A-type panel, when the ratio M/C ranges from 0.002 to 8.0, the contrast characteristic is excellent (◎) because a reflectance of the upper dielectric layer is sufficiently high due to a sufficiently large amount of Co-based material with respect to the content of oxide material.

When the ratio M/C ranges from 9.3 to 10.0, the contrast characteristic is good (○). In this case, the contrast characteristic may be slightly reduced due to a low reflectance of the upper dielectric layer.

When the ratio M/C is equal to or more than 12.0, the contrast characteristic is bad (X) because a reflectance of the upper dielectric layer is excessively low due to an excessively small amount of Co-based material with respect to the content of oxide material.

When the content of oxide material is 0.01 part by weight and the upper dielectric layer includes an excessively small amount of Co-based material of about 0.00084 part by weight, the ratio M/C has a value equal to or more than 12.0. In this case, the contrast characteristic may worsen due to an excessively low reflectance of the upper dielectric layer.

In the A-type panel, when the ratio M/C ranges from 0.002 to 0.006, the luminance is bad (X) because a transmittance of the upper dielectric layer is excessively low due to an excessively large amount of Co-based material with respect to the content of oxide material.

When the content of oxide material is 0.05 part by weight and the upper dielectric layer includes an excessively large amount of Co-based material of about 8.4 to 25 parts by weight, the ratio M/C has a value of 0.002 to 0.006. In this case, the luminance may be reduced due to an excessively low transmittance of the upper dielectric layer.

When the ratio M/C ranges from 0.0083 to 0.0141, the luminance is good (○). In this case, the luminance may be slightly reduced due to a low transmittance of the upper dielectric layer.

When the ratio M/C is equal to or more than 0.0167, the luminance is excellent (◎) because a transmittance of the upper dielectric layer is sufficiently high due to a sufficiently small amount of Co-based material with respect to the content of oxide material.

In the B-type panel, when the ratio M/C is 0.002, the luminance is bad (X) because a firing voltage is high due to an excessively small amount of oxide material with respect to the content of Co-based material.

When the ratio M/C ranges from 0.0055 to 0.0083, the luminance is good (○). When the ratio M/C ranges from 8.0 to 10.0, the luminance is good (○).

When the ratio M/C ranges from 0.0141 to 6.7, the luminance is excellent (◎) because a firing voltage between the scan electrode and the address electrode or between the sustain electrode and the address electrode is sufficiently low due to a sufficiently large amount of oxide material with respect to the content of Co-based material.

When the ratio M/C is equal to or more than 12.0, the luminance is bad (X). The reason is that particles of the oxide material may cover a considerable portion of the surface of the phosphor particles due to an excessively large amount of oxide material with respect to the content of Co-based material and thus the surface area of the phosphor material exposed to ultraviolet rays decreases.

Considering the description of FIG. 8, the ratio M/C of the content (M) of oxide material to the content (C) of Co-based material may range from 0.0083 to 10. Further, the ratio M/C may range from 0.0167 to 6.7.

When the content of blue pigment included in the upper dielectric layer is constant and the thickness of the upper dielectric layer increases, the panel reflectance is reduced and thus the contrast characteristic is improved. However, the panel transmittance is reduced and the luminance is reduced. Further, the thickness of the upper dielectric layer is constant and the content of blue pigment increases, the panel reflectance is reduced and thus the contrast characteristic is improved. However, the panel transmittance is reduced and the luminance is reduced.

Accordingly, the thickness of the upper dielectric layer may be determined depending on the content of blue pigment so as to lower the panel reflectance and raise the panel transmittance.

FIG. 9 is a table showing a contrast characteristic and a luminance of a displayed image depending on changes in a ratio of a thickness of an upper dielectric layer to a content of blue pigment.

In FIG. 9, T indicates a thickness of the upper dielectric layer in micrometer (μm), and C indicates a content of blue pigment in part by weight.

In an A-type panel, when a ratio T/C has a value of 10 to 500 by changing the content (C) of Co-based material in a state where the thickness T of the upper dielectric layer ranges from 33 μm to 39 μm, a contrast characteristic and a luminance of a displayed image are measured.

In a B-type panel, when a ratio T/C has a value of 10 to 500 by changing the thickness T of the upper dielectric layer in a state where the content (C) of Co-based material ranges from 0.1 to 0.6 part by weight, a contrast characteristic and a luminance of a displayed image are measured.

In FIG. 5, ◎ indicates that a contrast characteristic and a luminance are excellent, ○ indicates that a contrast characteristic and a luminance are good, and X indicates that a contrast characteristic and a luminance are bad.

In the A-type panel, when the ratio T/C ranges from 10 to 330, the contrast characteristic is excellent (◎) because a reflectance of the upper dielectric layer is sufficiently high due to the addition of a sufficient amount of Co-based material with respect to the thickness T of the upper dielectric layer.

When the thickness T of the upper dielectric layer is 33 μm and the content (C) of Co-based material is a sufficient amount of 0.1 to 3.3 parts by weight, the ratio T/C has a value of 10 to 330. In this case, the contrast characteristic can be improved due to a sufficiently high reflectance of the upper dielectric layer.

When the ratio T/C ranges from 390 to 480, the contrast characteristic is good (◎). In this case, the contrast characteristic may be slightly reduced due to a low reflectance.

When the ratio T/C is equal to or more than 500, the contrast characteristic is bad (X) because a reflectance is excessively low due to the addition of an insufficient amount of Co-based material with respect to the thickness T of the upper dielectric layer.

When the thickness T of the upper dielectric layer is 39 μm and the content (C) of Co-based material is an insufficient amount of about 0.078 part by weight, the ratio T/C has a value equal to or more than 500. In this case, the contrast characteristic may worsen due to an excessively low reflectance of the upper dielectric layer.

In the A-type panel, when the ratio T/C ranges from 10 to 30, the luminance is bad (X) because a transmittance is excessively low due to the addition of an excessively large amount of Co-based material with respect to the thickness T of the upper dielectric layer.

When the ratio T/C ranges from 40 to 80, the luminance is good (◎). In this case, the luminance may be slightly reduced due to a low transmittance.

When the ratio T/C is equal to or more than 110, the luminance is excellent (◎) because the transmittance is sufficiently high due to the addition of sufficiently small amount of Co-based material with respect to the thickness T of the upper dielectric layer.

In the B-type panel, when the ratio T/C is 10, the contrast characteristic is bad (X) because a reflectance of the upper dielectric layer is excessively low due to the excessively thin thickness T of the upper dielectric layer with respect to the content of Co-based material.

When the content of Co-based material is 0.1 part by weight and the thickness T of the upper dielectric layer is about 1 μm, the ratio T/C has a value of 10. In this case, the contrast characteristic may worsen due to an excessively low reflectance of the upper dielectric layer.

When the ratio T/C ranges from 30 to 60, the contrast characteristic is good (○). In this case, the contrast characteristic may be slightly reduced due to a low reflectance.

When the ratio T/C is equal to or more than 80, the contrast characteristic is excellent (◎) because the reflectance of the upper dielectric layer is sufficiently high due to the sufficiently thick thickness T of the upper dielectric layer with respect to the content of Co-based material.

When the content of Co-based material is 0.6 part by weight and the thickness T of the upper dielectric layer ranges from 48 μm to 300 μm, the ratio T/C has a value equal to or more than 80. In this case, the contrast characteristic can be improved due to a sufficiently high reflectance of the upper dielectric layer.

In the B-type panel, when the ratio T/C ranges from 10 to 260, the luminance is excellent (◎) because a transmittance of the upper dielectric layer is sufficiently high due to the sufficiently thin thickness T of the upper dielectric layer with respect to the content of Co-based material.

When the ratio T/C ranges from 290 to 420, the luminance is good (○). In this case, the luminance may be slightly reduced due to a low transmittance.

When the ratio T/C is equal to or more than 480, the luminance is bad (X) because the transmittance is excessively low due to the excessively thick upper dielectric layer with respect to the content of Co-based material.

Considering the description of FIG. 9, the ratio T/C of the thickness T of the upper dielectric layer to the content (C) of Co-based material may range from 40 to 420. Further, the ratio T/C may range from 110 to 260.

Figures 10A, 10B:
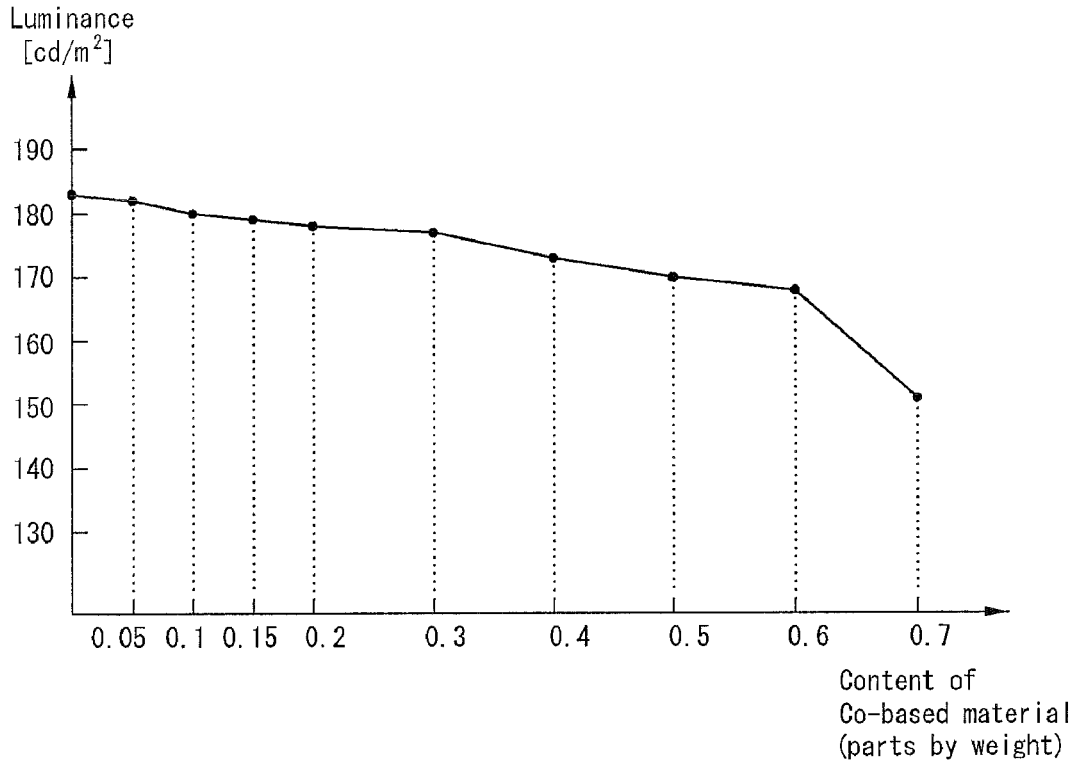
FIGS. 10A and 10B are a table and a graph showing characteristics of the plasma display panel depending on a content of blue pigment.

FIG. 10A is a table measuring a dark room contrast ratio, a bright room contrast ratio, a reflectance and a color temperature of the panel when a content of Co-based material used as the blue pigment is 0, 0.05, 0.1, 0.15, 0.2, 0.3, 0.5, 0.6, 0.7, and 1.0 part by weight, respectively. FIG. 10B is a graph showing a luminance of the panel under the same conditions as FIG. 1A. A thickness of the upper dielectric layer is fixed to 38 μm.

The dark room contrast ratio measures a contrast ratio in a state where an image with a window pattern corresponding to 1% of the screen size is displayed in a dark room.

The bright room contrast ratio measures a contrast ratio in a state where an image with a window pattern corresponding to 25% of the screen size is displayed in a bright room.

As illustrated in FIG. 10A, when the upper dielectric layer does not include Co-based material, a dark room contrast ratio is 9920:1, a bright room contrast ratio is 52:1, a reflectance is 35%, and a color temperature is 7100K.

When the content of Co-based material is 0.05 part by weight, the dark room contrast ratio is 9950:1, the bright room contrast ratio is 53:1, the reflectance is 34%, and the color temperature is 7200K.

As above, when the upper dielectric layer includes a small amount of Co-based material equal to or less than 0.05 part by weight, the contrast ratio is reduced, the reflectance is high, and the color temperature is low.

When the content of Co-based material is 0.1 part by weight, the dark room contrast ratio is 10900:1, the bright room contrast ratio is 60:1, the reflectance is 31%, and the color temperature is 7500K. In other words, as the content of Co-based material increases, the contrast ratio increases, the reflectance is reduced, and the color temperature increases.

The upper dielectric layer has a blue-based color due to the properties of the Co-based material, and thus can absorb light coming from the outside. Hence, the contrast characteristic is improved and the reflectance is reduced.

Further, when visible light coming from the inside of the panel is emitted to the outside of the panel through the upper dielectric layer having a blue-based color, blue visible light can be more clearly emitted due to the upper dielectric layer. Hence, the color temperature can be improved.

When the content of Co-based material ranges from 0.15 to 0.3 part by weight, the dark room contrast ratio ranges from 11500:1 to 12160:1, the bright room contrast ratio ranges from 62:1 to 67:1, the reflectance ranges from 25.2% to 29%, and the color temperature ranges from 8050K to 8400K. In other words, when the content of Co-based material ranges from 0.15 to 0.3 part by weight, the contrast ratio, the reflectance and the color temperature can be improved.

When the content of Co-based material is equal to or more than 0.5 part by weight, the dark room contrast ratio is equal to or more than 12700:1, the bright room contrast ratio is equal to or more than 68:1, the reflectance is equal to or less than 24%, and the color temperature is equal to or more than 8500K.

As illustrated in FIG. 10B, when the upper dielectric layer does not include the Co-based material, a luminance of a displayed image is about 183 cd/m$^2$.

When the content of Co-based material is 0.05 part by weight, the luminance is reduced to about 182 cd/m$^2$. Because the upper dielectric layer has a blue-based color due to the Co-based material, a transmittance of the upper dielectric layer is reduced and thus the luminance is reduced.

When the content of Co-based material is 0.1 part by weight, the luminance is about 180 cd/m$^2$. When the content of Co-based material ranges from 0.15 to 0.3 part by weight, the luminance ranges from about 177 to 179 cd/m$^2$.

When the content of Co-based material ranges from 0.4 to 0.6 part by weight, the luminance ranges from about 168 to 173 cd/m$^2$.

When the upper dielectric layer includes a large amount of Co-based material equal to or more than 0.7 part by weight, the transmittance of the upper dielectric layer is excessively reduced. Hence, the luminance is sharply reduced to a value equal to or less than about 151 cd/m$^2$.

Considering the description of FIGS. 10A and 10B, the content of Co-based material as the pigment may range from 0.01 to 0.6 part by weight so as to prevent a reduction in the luminance caused by an excessive reduction in the transmittance of the upper dielectric layer while the reflectance is reduced and the contrast ratio and the color temperature increase. Further, the content of Co-based material may range from 0.15 to 0.3 part by weight.

The blue pigment may include at least one of a Cu-based material, a Cr-based material, a Ni-based material, an Al-based material, a Ti-based material, a Ce-based material, a Mn-based material or an Nd-based material, in addition to the Co-based material used as a main material.

In case that the Ni-based material is added to the Co-based material, the upper dielectric layer may be dark blue. Therefore, an image of dark blue can be more clearly displayed on the screen. When an excessively large amount of Ni-based material is added, the transmittance of the upper dielectric layer can be excessively reduced. Therefore, a content of Ni-based material may range from 0.1 to 0.2 part by weight.

In case that the Cr-based material is added to the Co-based material, the upper dielectric layer may have a mixed color of red and blue. Therefore, an image with the mixed color can be more clearly displayed on the screen. In other words, a color representable range of the image can increase. A content of Cr-based material may range from 0.1 to 0.3 part by weight.

In case that the Cu-based material is added to the Co-based material, the upper dielectric layer may have a mixed color of green and blue. Therefore, an image with the mixed color can be more clearly displayed on the screen. In other words, a color representable range of the image can increase. A content of Cu-based material may range from 0.03 to 0.09 part by weight.

In case that the Ce-based material is added to the Co-based material, the upper dielectric layer may have a mixed color of yellow and blue. Therefore, an image with the mixed color can be more clearly displayed on the screen. In other words, a color representable range of the image can increase. A content of Ce-based material may range from 0.1 to 0.3 part by weight.

In case that the Mn-based material is added to the Co-based material, a blue color of the upper dielectric layer may be deep. Therefore, a color temperature of a displayed image can increase. A content of Mn-based material may range from 0.2 to 0.6 part by weight.

Figure 11:
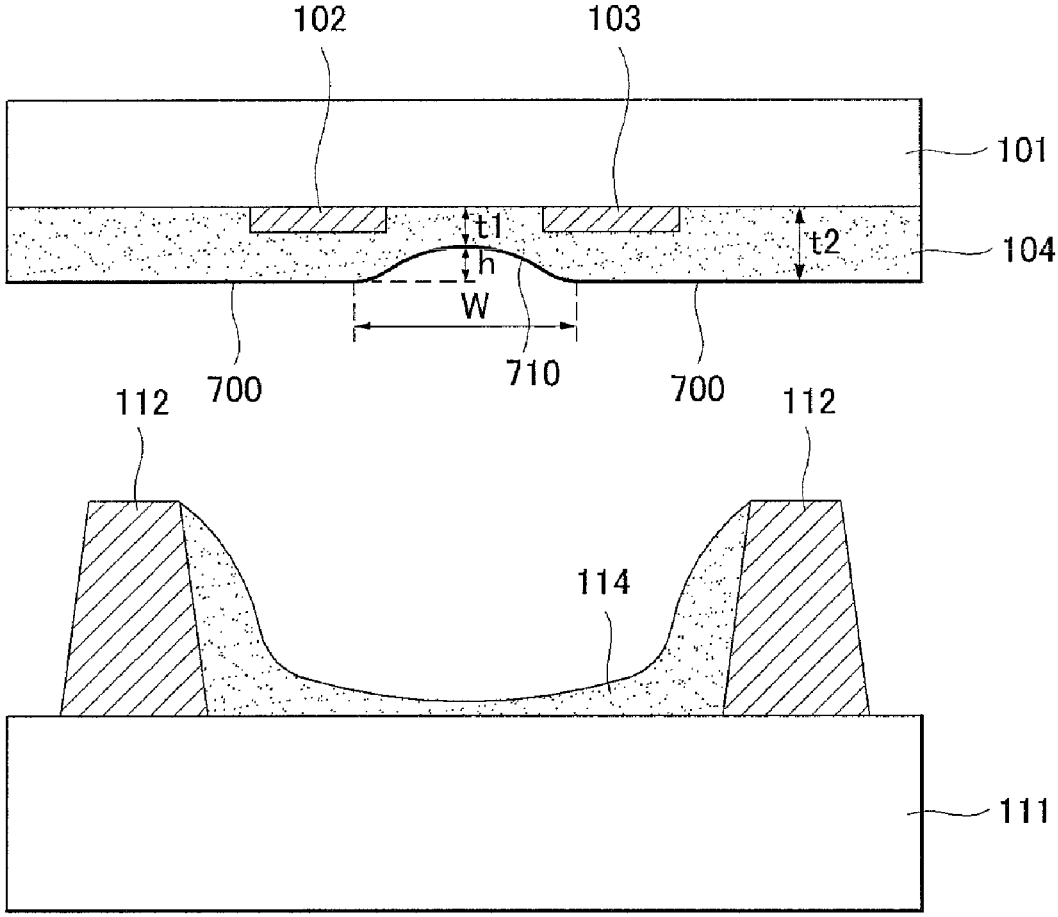
FIG. 11 illustrates another structure of an upper dielectric layer.

FIG. 11 illustrates another structure of an upper dielectric layer.

As illustrated in FIG. 11, the upper dielectric layer 104 includes a convex portion 700 and a concave portion 710 with a thickness smaller than a thickness of the convex portion 700=

The concave portion 710 may be positioned between the scan electrode 102 and the sustain electrode 103.

A largest thickness of the upper dielectric layer 104 (i.e., a thickness of the upper dielectric layer 104 in the convex portion 700) is t2, and a thickness of the upper dielectric layer 104 in the concave portion 710 is t1. A depth of the concave portion 710 is h, and a width of the concave portion 710 is W.

When a discharge occurs by applying a driving signal to the scan electrode 102 and the sustain electrode 103, most of wall charges may be accumulated on the concave portion 710. Therefore, a discharge path can shorten due to the structure of the upper dielectric layer 104 of FIG. 11. As a result, a firing voltage between the scan electrode 102 and the sustain electrode 103 is lowered and thus the driving efficiency can be improved.

A transmittance of the upper dielectric layer 104 with a blue-based color by including a Co-based material is smaller than a transmittance of the transparent upper dielectric layer 104 not including the Co-based material. Hence, a luminance of a displayed image may be reduced.

On the contrary, as illustrated in FIG. 11, when the upper dielectric layer 104 includes the convex portion 700 and the concave portion 710, a firing voltage between the scan electrode 102 and the sustain electrode 103 can be lowered and thus a reduction in the luminance caused by the Co-based material can be compensated.

Figure 12:
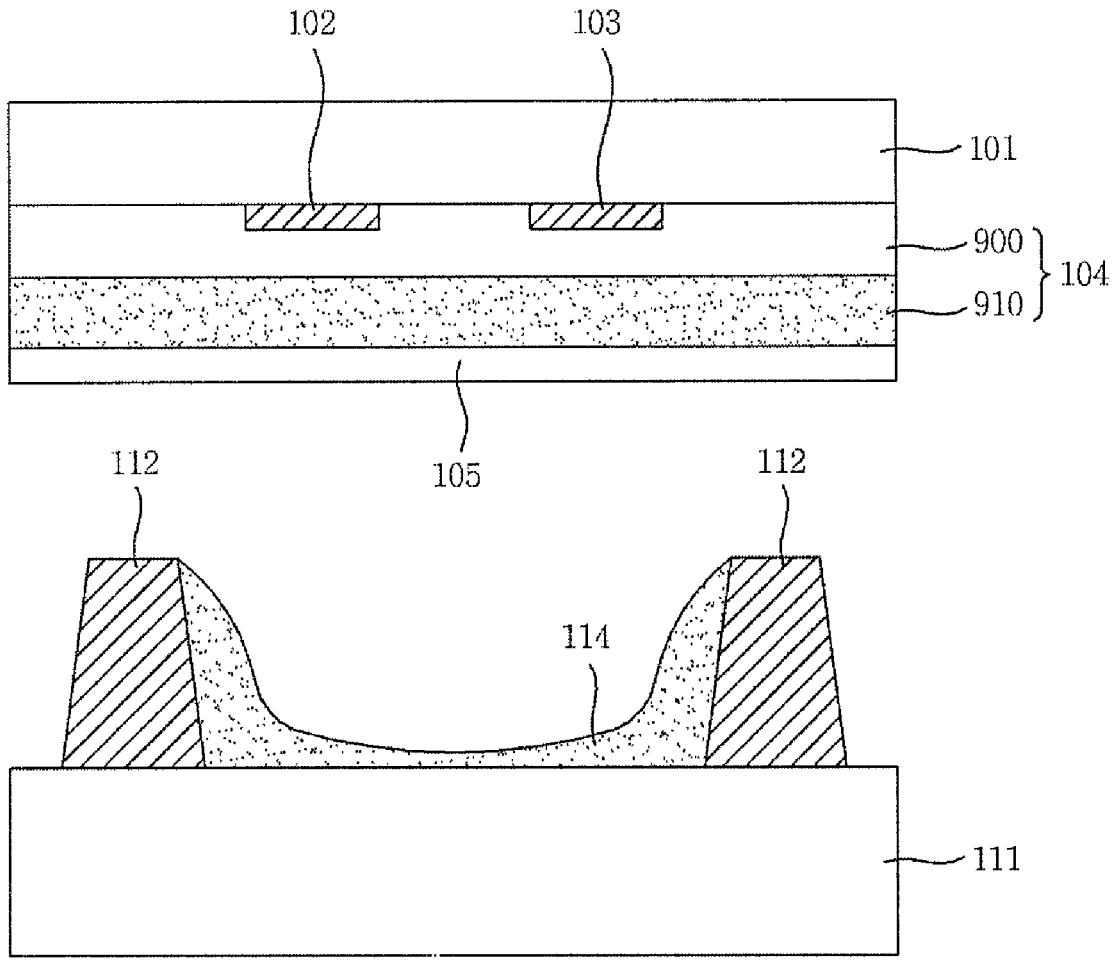
FIG. 12 illustrates another structure of an upper dielectric layer.

FIG. 12 illustrates another structure of an upper dielectric layer.

As illustrated in FIG. 12, the upper dielectric layer 104 has a two-layered structure. For instance, the upper dielectric layer 104 includes a first upper dielectric layer 900 and a second upper dielectric layer 910 which are stacked in turn.

At least one of the first upper dielectric layer 900 or the second upper dielectric layer 910 may include a pigment. If the upper dielectric layer 104 includes a metal pigment, a permittivity of the upper dielectric layer 104 may be reduced.

It is advantageous that a permittivity of the first upper dielectric layer 900 is relatively high because the first upper dielectric layer 900 covers the scan electrode 102 and the sustain electrode 103 and provides insulation between the scan electrode 102 and the sustain electrode 103. Therefore, the first upper dielectric layer 900 may not include a pigment, and the second upper dielectric layer 910 positioned on the first upper dielectric layer 900 may include a pigment.

Figure 13:
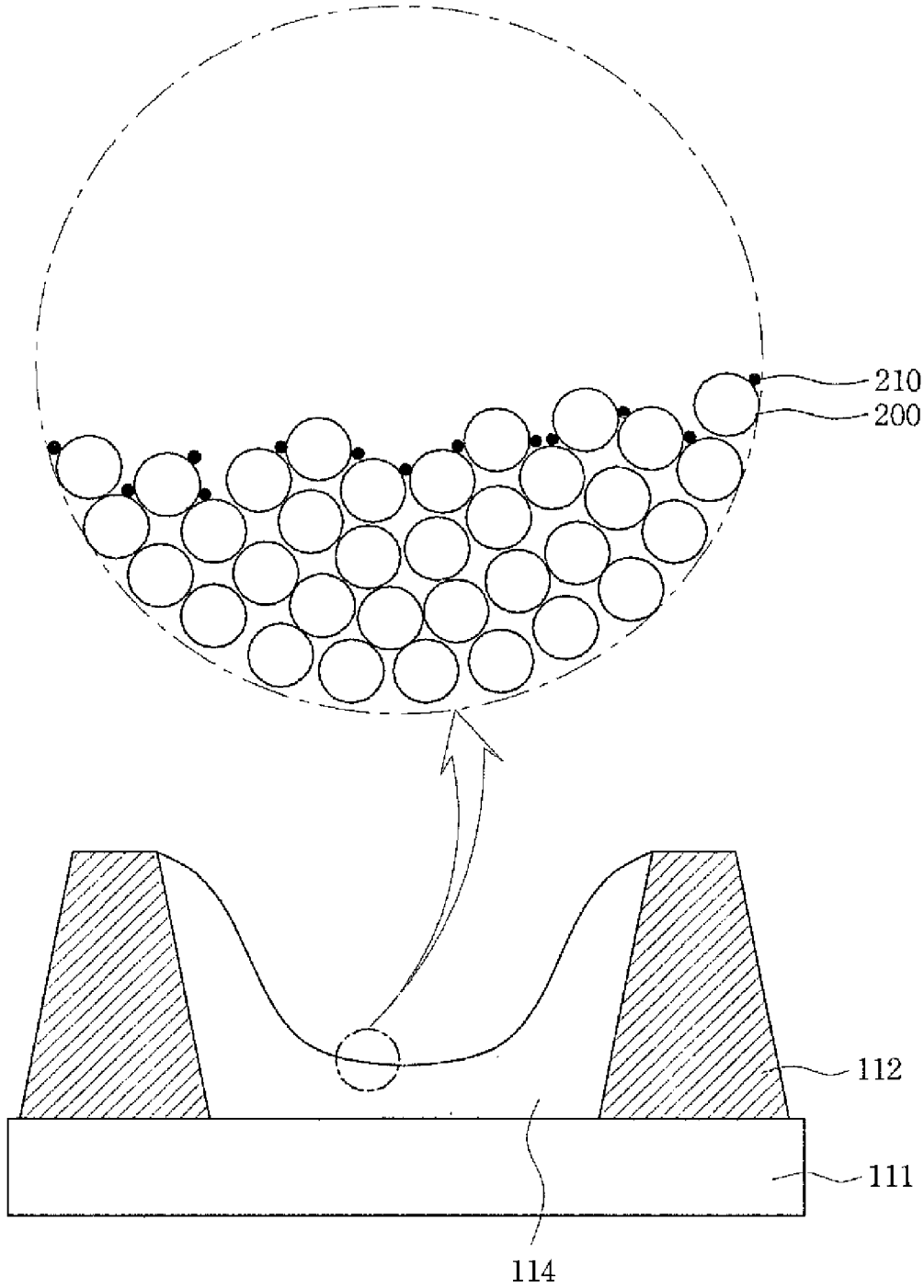
FIG. 13 illustrates an implementation of the distribution of particles of an oxide material of a phosphor layer.

FIG. 13 illustrates an implementation of the distribution of particles of an oxide material of a phosphor layer.

As illustrated in FIG. 13, at least one of particles 200 of a phosphor material may be exposed on the surface of the phosphor layer 114 in a direction toward the discharge cell. For instance, since particles 210 of an oxide material are positioned between the particles 200 of the phosphor material on the surface of the phosphor layer 114, at least one phosphor particle 200 may be exposed.

Since the oxide particles 210 are positioned between the phosphor particles 200, a discharge response characteristic between the scan electrode and the address electrode or between the sustain electrode and the address electrode can be improved.

Figure 14:
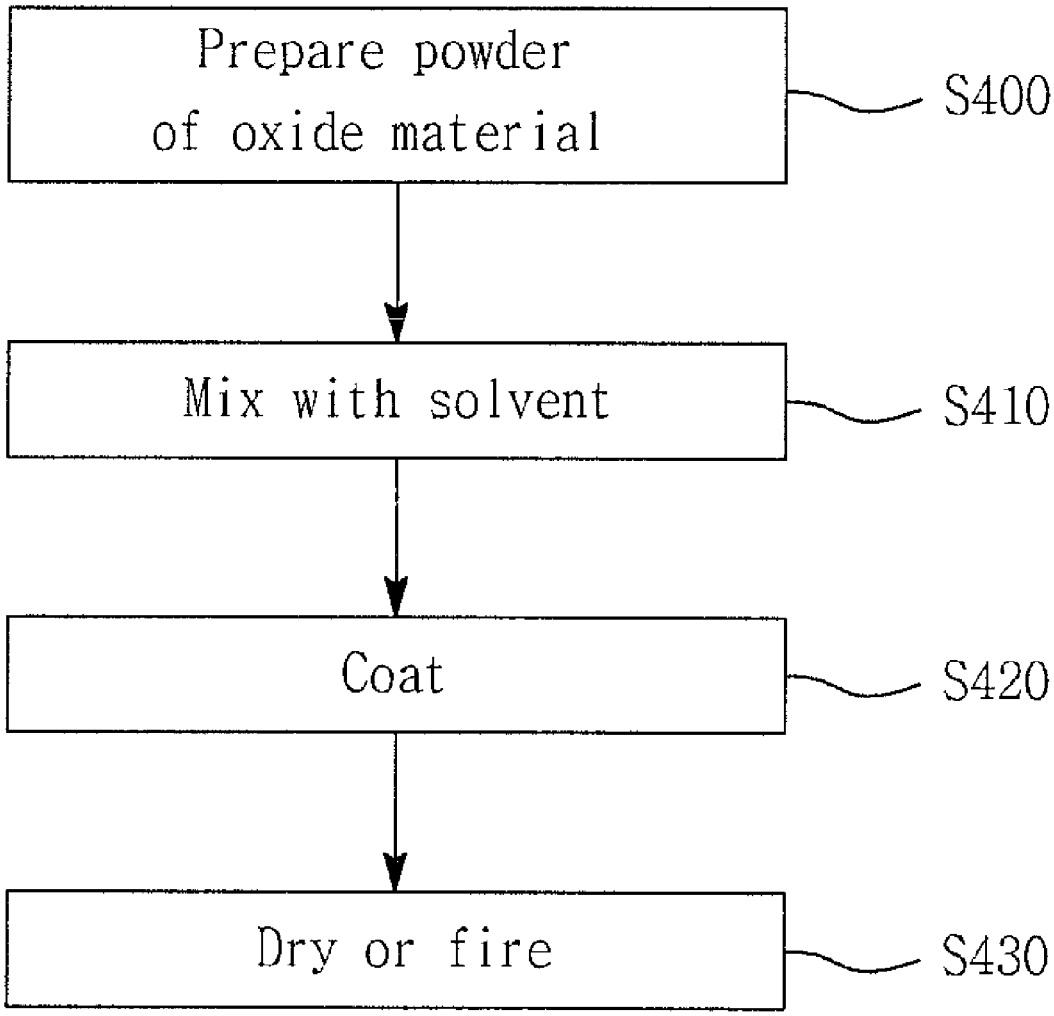
FIG. 14 illustrates an implementation of a method of manufacturing a phosphor layer.

FIG. 14 illustrates an implementation of a method of manufacturing a phosphor layer.

As illustrated in FIG. 14, first, a powder of an oxide material is prepared in step S400. For instance, a gas oxidation process is performed on Mg vapor generated by heating Mg to form a powder of MgO material.

Next, the prepared oxide power is mixed with a solvent in step S410. For instance, the resulting MgO powder is mixed with methanol to manufacture an oxide paste or an oxide slurry.

Subsequently, the oxide paste or slurry is coated on the phosphor layer in step S420. In this case, a viscosity of the oxide paste or slurry is adjusted so that the oxide particles are smoothly positioned between the phosphor particles.

Subsequently, a drying process or a firing process is performed in step S430. Hence, the solvent mixed with the oxide powder is evaporated to form the phosphor layer of FIG. 13.

Figure 15:
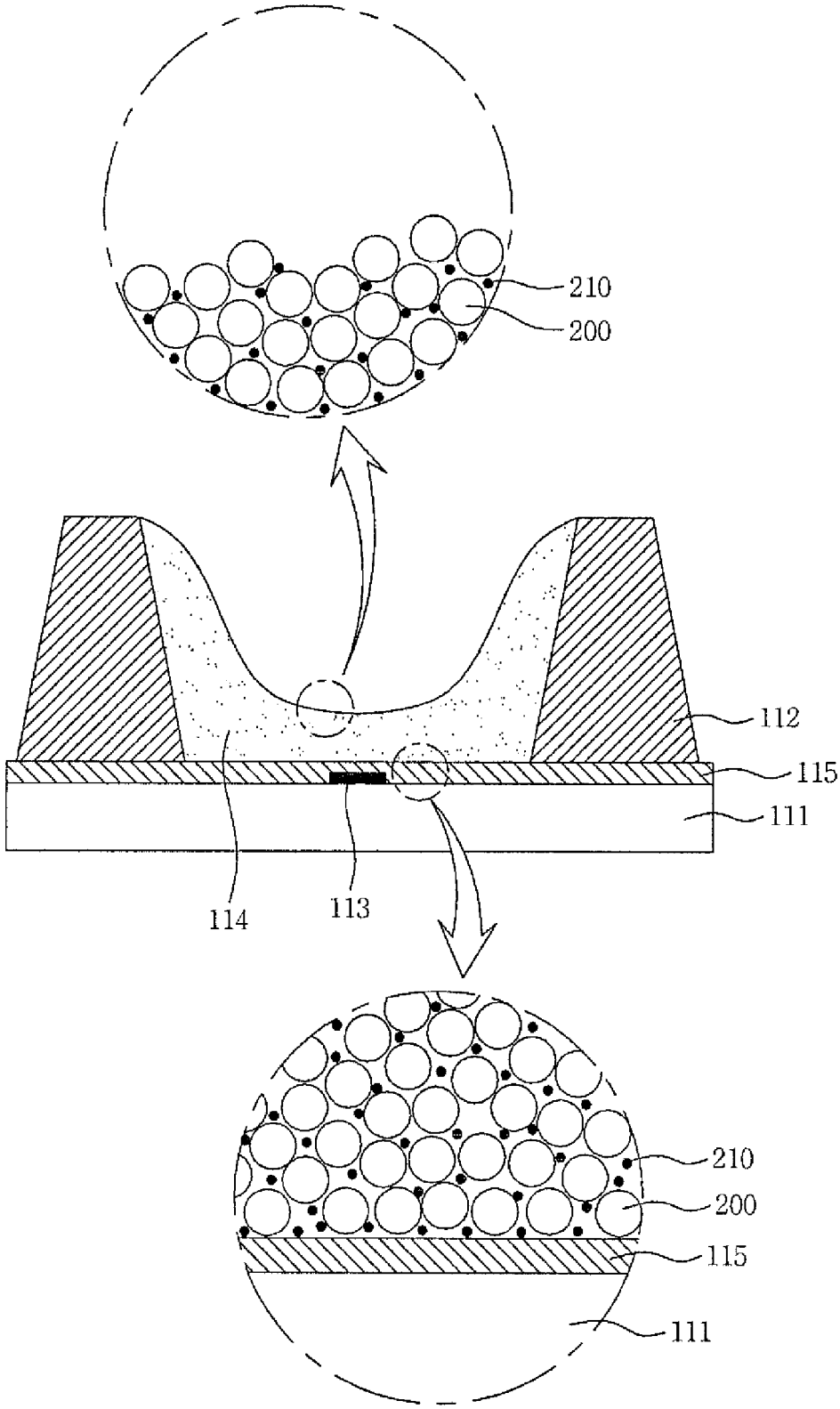
FIG. 15 illustrates another implementation of the distribution of particles of an oxide material of a phosphor layer.

FIG. 15 illustrates another implementation of the distribution of particles of an oxide material of a phosphor layer.

As illustrated in FIG. 15, particles 210 of an oxide material may be positioned on the surface of the phosphor layer 114, inside the phosphor layer 114, and between the phosphor layer 114 and the lower dielectric layer 115.

Since the oxide particles 210 are positioned between the phosphor particles 200, a discharge response characteristic between the scan electrode and the address electrode or between the sustain electrode and the address electrode can be improved.

Figure 16:
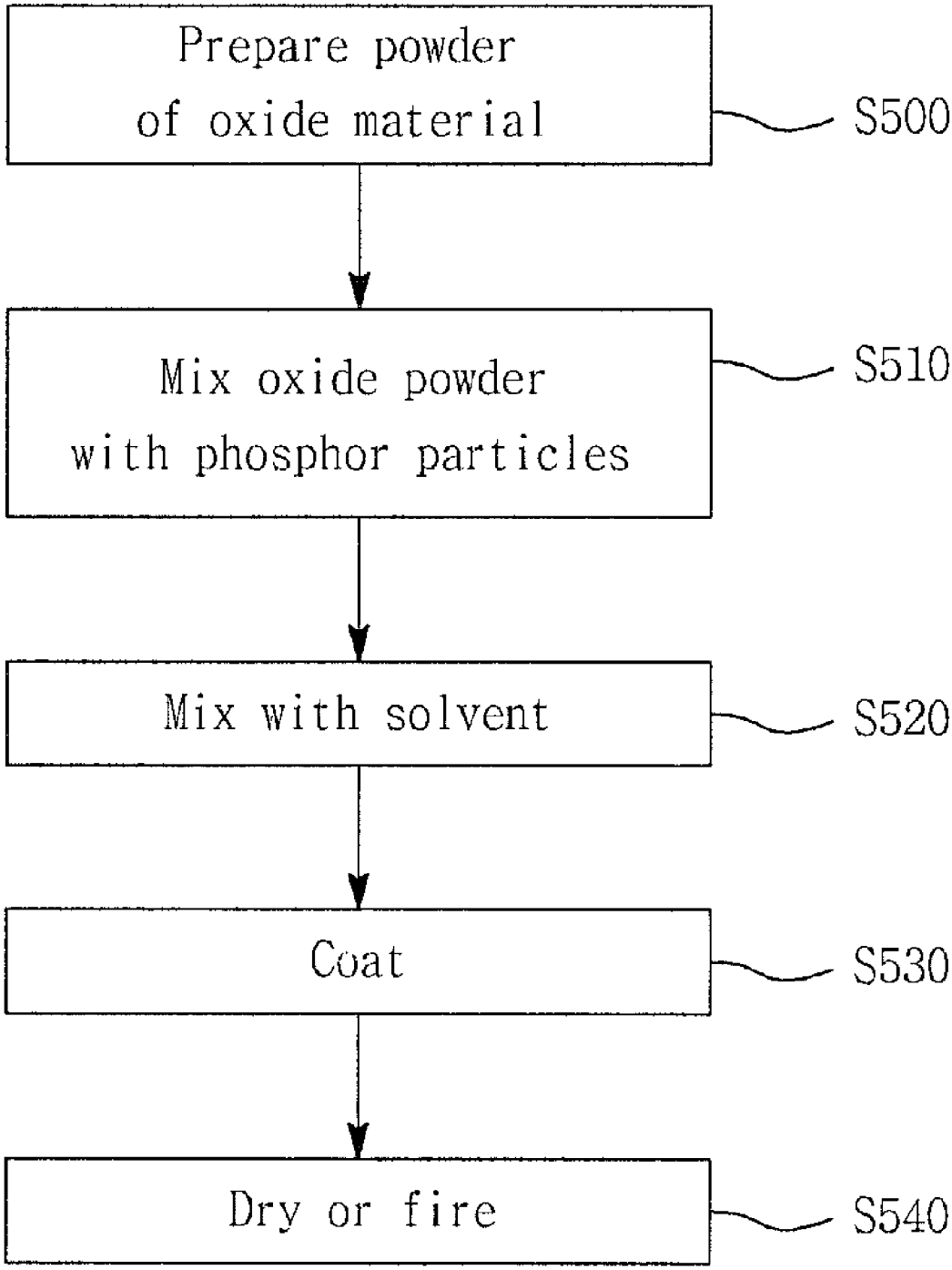
FIG. 16 illustrates another implementation of a method of manufacturing a phosphor layer.

FIG. 16 illustrates another implementation of a method of manufacturing a phosphor layer.

As illustrated in FIG. 16, a powder of an oxide material is prepared in step S500.

The prepared oxide power is mixed with phosphor particles in step S510.

The oxide power and the phosphor particles are mixed with a solvent in step S520.

The oxide power and the phosphor particles mixed with the solvent are coated inside the discharge cells in step S530. In this case, a dispensing method may be used.

A drying process or a firing process is performed in step S540 to evaporate the solvent. Hence, a phosphor layer with a structure illustrated in FIG. 15 is formed.

Figure 17A:
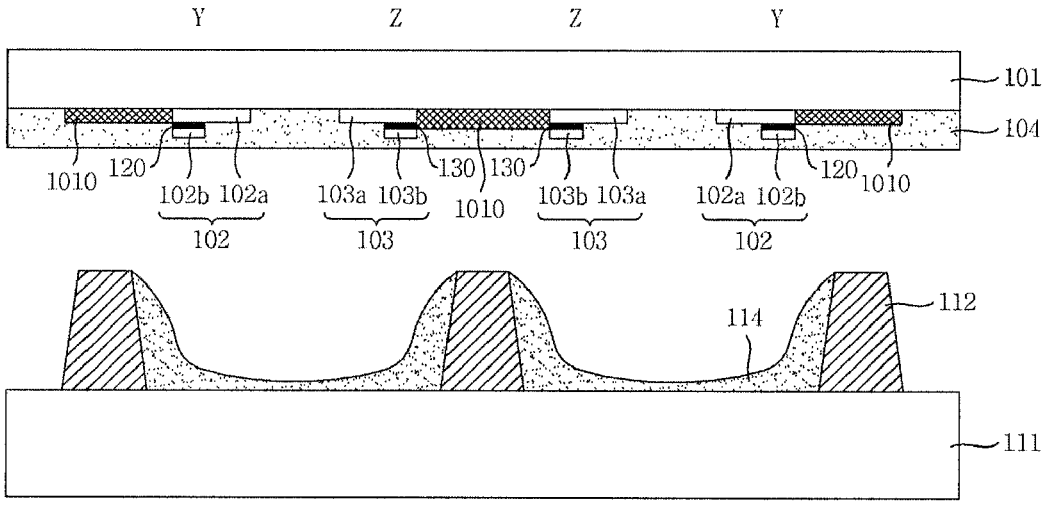
FIGS. 17A and 17B illustrate another structure of the plasma display panel according to the exemplary embodiment.
Figure 17B:
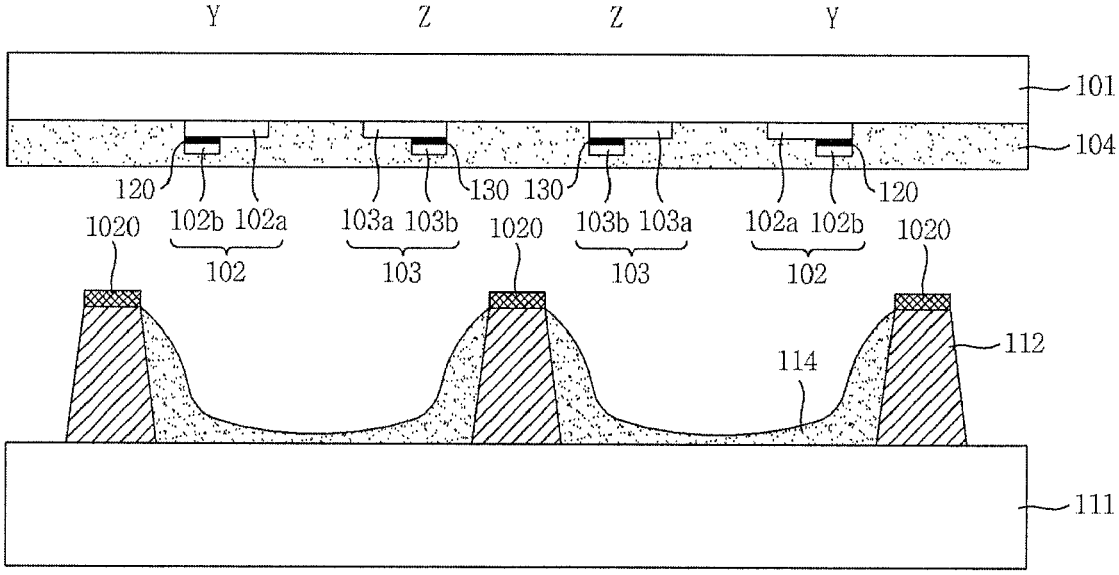

FIGS. 17A and 17B illustrate another structure of the plasma display panel according to the exemplary embodiment.

As illustrated in FIG. 17A, a black matrix 1010 overlapping the barrier rib 112 is positioned on the front substrate 101. The black matrix 1010 absorbs incident light, and thus suppresses the reflection of light caused by the barrier rib 112. Hence, a panel reflectance is reduced and a contrast characteristic can be improved.

In FIG. 17A, the black matrix 1010 is positioned on the front substrate 101. However, the black matrix 1010 may be positioned on the upper dielectric layer (not shown).

Black layers 120 and 130 are positioned between the transparent electrodes 102*a* and 103*a* and the bus electrodes 102*b* and 103*b*, respectively. The black layers 120 and 130 prevent the reflection of light caused by the bus electrodes 102*b* and 103*b*, thereby reducing a panel reflectance As illustrated in FIG. 17B, a top black matrix 1020 is formed on the barrier rib 112. Since the top black matrix 1020 reduces a panel reflectance, a black matrix may not be formed on the front substrate 101.

As described above, when the phosphor layer includes a pigment, the panel reflectance can be further reduced.

The black layers 120 and 130, the black matrix 1010 and the top black matrix 1020 may be omitted from the plasma display panel. Because the pigment mixed with the phosphor layer can sufficiently reduce the panel reflectance, a sharp increase in the panel reflectance can be prevented although the black layers 120 and 130, the black matrix 1010 and the top black matrix 1020 are omitted.

A removal of the black layers 120 and 130, the black matrix 1010 and the top black matrix 1020 can make a manufacturing process of the panel simpler, and reduce the manufacturing cost.

A width of at least one of the black matrix 1010 of FIG. 17A or the top black matrix 1020 of FIG. 17B may be smaller than an upper width of the barrier rib 112. In this case, an aperture ratio can be sufficiently secured and an excessive reduction in a luminance can be prevented.

Figure 18:
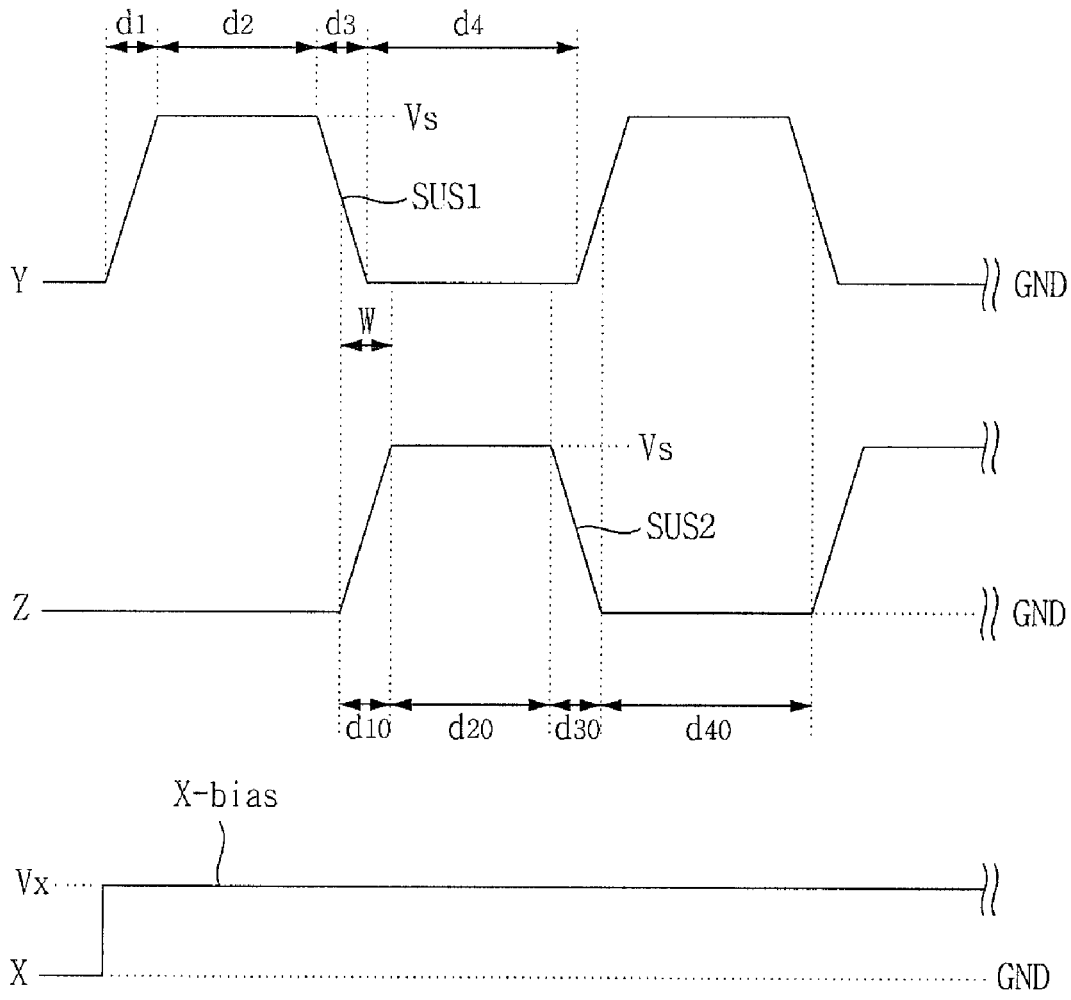
FIG. 18 is a diagram for explaining the overlap of sustain signals.

FIG. 18 is a diagram for explaining the overlap of sustain signals.

As illustrated in FIG. 18, a first sustain signal SUS1 and a second sustain signal SUS2 are alternately supplied to the scan electrode Y and the sustain electrode Z. The first sustain signal SUS1 and the second sustain signal SUS2 may overlap each other.

The first sustain signal SUS1 includes a voltage rising period d1, a first voltage maintenance period d2 during which the first sustain signal SUS1 is maintained at a highest voltage Vs, a voltage falling period d3, and a second voltage maintenance period d4 during which the first sustain signal SUS1 is maintained at a lowest voltage GND. The second sustain signal SUS2 includes a voltage rising period d10, a first voltage maintenance period d20 during which the second sustain signal SUS2 is maintained at a highest voltage Vs, a voltage falling period d30, and a second voltage maintenance period d40 during which the second sustain signal SUS2 is maintained at a lowest voltage GND. The voltage falling period d3 of the first sustain signal SUS1 may overlap the voltage rising period d10 of the second sustain signal SUS2.

When two successively applied sustain signals overlap each other, the number of sustain signals capable of being applied during a sustain period can increase. Hence, a luminance can be improved. Further, the overlap of the sustain signals can compensate for a reduction in a luminance caused by the pigment included in the phosphor layer.

An address bias signal X-Bias, which is maintained at a voltage Vx higher than the ground level voltage GND, is supplied to the address electrode X during the sustain period. Hence, a voltage difference between the scan electrode Y and the address electrode X and a voltage difference between the sustain electrode Z and the address electrode X can be reduced during the sustain period. Furthermore, a sustain discharge between the scan electrode Y and the sustain electrode Z can occur close to the front substrate. The efficiency of the sustain discharge can be improved and a degradation of the phosphor layer can be suppressed.

Figure 19:
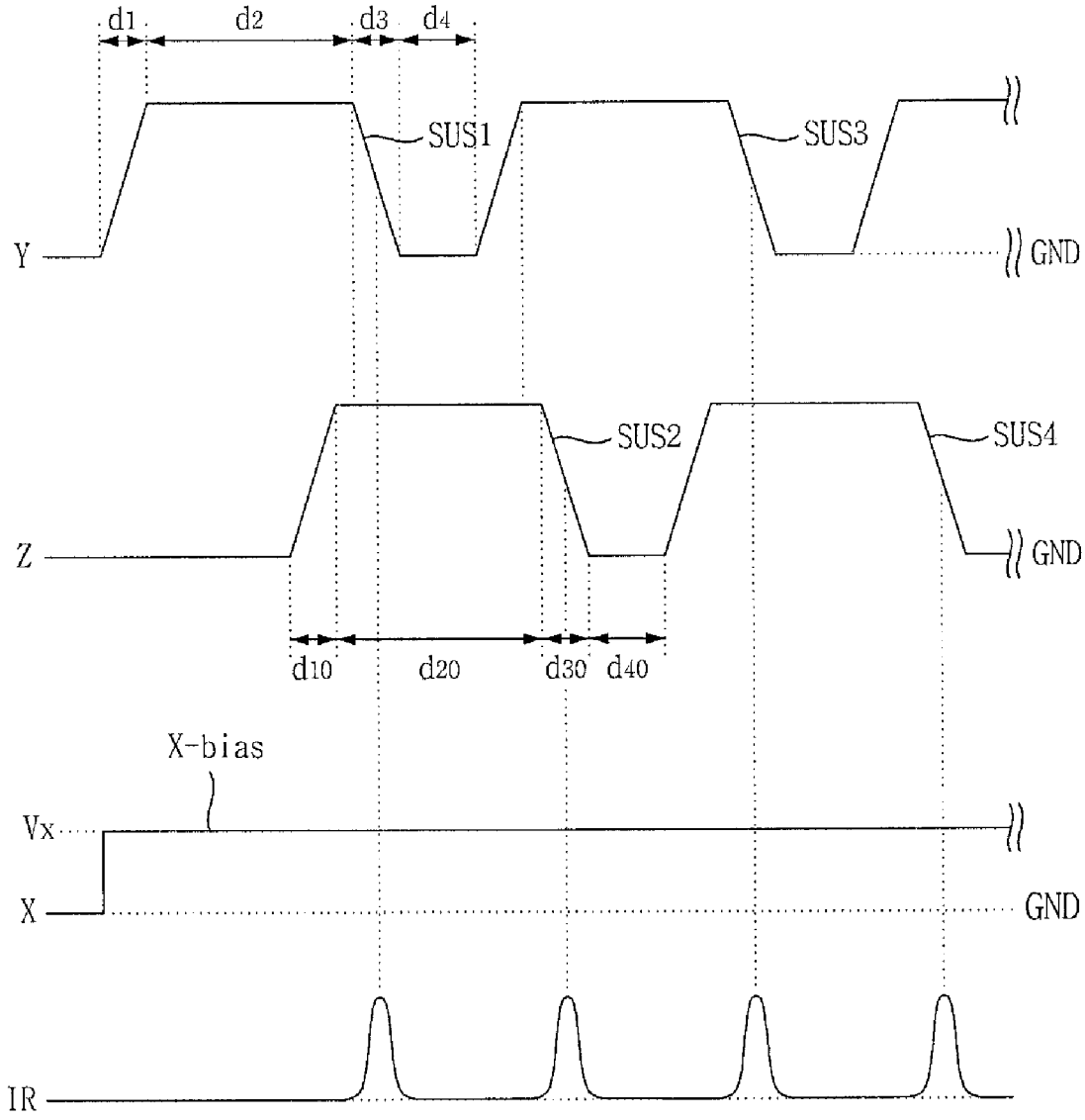
FIG. 19 is a diagram for explaining a first voltage maintenance period and a second voltage maintenance period.

FIG. 19 is a diagram for explaining a first voltage maintenance period and a second voltage maintenance period.

As illustrated in FIG. 19, the voltage falling period d3 of the first sustain signal SUS1 may overlap the first voltage maintenance period d20 of the second sustain signal SUS2.

A sustain discharge may occur due to an increase in a voltage difference between the scan electrode and the sustain electrode during the voltage falling periods d3 and d30 of the first and second sustain signals SUS1 and SUS2.

Further, a sustain discharge may occur due to an increase in a voltage difference between the scan electrode and the sustain electrode during the voltage rising periods d1 and d10 of the first and second sustain signals SUS1 and SUS2. In this case, a self-erase discharge may frequently occur due to electrons moving from the phosphor layer in a direction toward the scan electrode or the sustain electrode, and thus wall charges accumulated on the scan electrode or the sustain electrode may be erased. Hence, the sustain discharge may unstably occur due to the insufficient amount of wall charges. The self-erase discharge may more frequently occur due to an increase in an interference of the phosphor layer when an interval between the scan electrode and the sustain electrode is relatively wide, for instance, when an interval between the scan electrode and the sustain electrode is larger than a height of the barrier rib.

On the contrary, when a sustain discharge occurs due to an increase in the voltage difference between the scan electrode and the sustain electrode during the voltage falling periods d3 and d30, the sustain discharge occurs due to electrons moving from the scan electrode or the sustain electrode to a direction toward the phosphor layer. Hence, a self-erase discharge can be suppressed. The generation of the self-erase discharge can be suppressed although the interval between the scan electrode and the sustain electrode is larger than the height of the barrier rib.

As above, a time width of each of the first voltage maintenance periods d2 and d20 may be longer than a time width of each of the second voltage maintenance periods d4 and d40 so as to increase the voltage difference between the scan electrode and the sustain electrode during the voltage falling periods d3 and d30. Hence, the voltage falling period d3 can overlap the first voltage maintenance period d20, and thus sustain discharge can occur during the voltage falling period d3. Further, the self-erase discharge can be suppressed.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate including a scan electrode and a sustain electrode positioned parallel to each other;

an upper dielectric layer positioned on the scan electrode and the sustain electrode, the upper dielectric layer including a glass-based material and a blue pigment;

a rear substrate on which an address electrode is positioned to intersect the scan electrode and the sustain electrode;

a lower dielectric layer positioned on the address electrode;

a barrier rib positioned between the front substrate and the rear substrate and that partitions a discharge cell; and a phosphor layer positioned inside the discharge cell, the phosphor layer including a phosphor material and magnesium oxide (MgO) materials wherein the magnesium oxide (MgO) material is (111), (222), (444)-oriented MgO materials to suppress a degradation of the phosphor layer and to reduce discharge delay time.

2. The plasma display panel of claim 1, wherein the blue pigment includes at least one of a cobalt (Co)-based material, a copper (Cu)-based material, a chrome (Cr)-based material, a nickel (Ni)-based material, an aluminum (Al)-based material, a titanium (Ti)-based material, a cerium (Ce)-based material, a manganese (Mn)-based material or a neodymium (Nd)-based material.

3. The plasma display panel of claim 1, wherein a content of the blue pigment ranges from 0.1 to 0.6 part by weight.

4. The plasma display panel of claim 1, wherein a ratio of a content of MgO material to a content of the blue pigment ranges from 0.0083 to 10.

5. The plasma display panel of claim 1, wherein at least one of particles of the phosphor material is exposed on a surface of the phosphor layer in a direction toward the discharge cell.

6. The plasma display panel of claim 1, wherein particles of the MgO material are positioned on a surface of the phosphor layer, inside the phosphor layer, and between the phosphor layer and the lower dielectric layer.

7. A plasma display panel comprising:

a front substrate including a scan electrode and a sustain electrode positioned parallel to each other;

an upper dielectric layer positioned on the scan electrode and the sustain electrode, the upper dielectric layer including a glass-based material and a blue pigment;

a rear substrate on which an address electrode is positioned to intersect the scan electrode and the sustain electrode;

a lower dielectric layer positioned on the address electrode;

a barrier rib positioned between the front substrate and the rear substrate and that partitions a discharge cell; and a phosphor layer positioned inside the discharge cell, the phosphor layer including a phosphor material and magnesium oxide (MgO) material, wherein a thickness of the upper dielectric layer is indicated as T in micrometer (μm), and a content of the MgO material is indicated as M in part by weight, a ratio of the content of the MgO material to the thickness of the upper dielectric layer (M/T) ranges from 0.0001 to 0.04, and wherein the magnesium oxide (MgO) material is (111), (222), (444)-oriented MgO materials to suppress a degradation of the phosphor layer and to reduce discharge delay time.

8. The plasma display panel of claim 7, wherein the blue pigment includes at least one of a cobalt (Co)-based material, a copper (Cu)-based material, a chrome (Cr)-based material, a nickel (Ni)-based material, an aluminum (Al)-based material, a titanium (Ti)-based material, a cerium (Ce)-based material, a manganese (Mn)-based material or a neodymium (Nd)-based material.

9. The plasma display panel of claim 7, wherein a content of the blue pigment ranges from 0.1 to 0.6 part by weight.

10. The plasma display panel of claim 7, wherein a ratio of a content of MgO material to a content of the blue pigment ranges from 0.0083 to 10.

11. A plasma display panel comprising:

a front substrate including a scan electrode and a sustain electrode positioned parallel to each other;

an upper dielectric layer positioned on the scan electrode and the sustain electrode, the upper dielectric layer including a glass-based material and a blue pigment;

a rear substrate on which an address electrode is positioned to intersect the scan electrode and the sustain electrode;

a lower dielectric layer positioned on the address electrode;

a barrier rib positioned between the front substrate and the rear substrate and that partitions a discharge cell; and a phosphor layer positioned inside the discharge cell, the phosphor layer including a phosphor material and magnesium oxide (MgO) material, wherein a thickness of the upper dielectric layer is indicated as T in micrometer (μm), and a content of the blue pigment is indicated as C in part by weight, wherein a ratio of the thickness of the upper dielectric layer to the content of blue pigment (T/C) ranges from 40 to 420, wherein the magnesium oxide (MgO) material is (111), (222), (444)-oriented MgO materials to suppress a degradation of the phosphor layer and to reduce discharge delay time, wherein the upper dielectric layer includes a convex portion and a concave portion having a thickness less than a thickness of the convex portion, and the concave portion is positioned between the scan electrode and the sustain electrode, and wherein the concave portion partially overlaps the scan electrode and the sustain electrode.

12. The plasma display panel of claim 11, wherein the blue pigment includes at least one of a cobalt (Co)-based material, a copper (Cu)-based material, a chrome (Cr)-based material, a nickel (Ni)-based material, an aluminum (Al)-based material, a titanium (Ti)-based material, a cerium (Ce)-based material, a manganese (Mn)-based material or a neodymium (Nd)-based material.

13. The plasma display panel of claim 11, wherein a content of the blue pigment ranges from 0.1 to 0.6 part by weight.

14. The plasma display panel of claim 11, wherein a ratio of a content of the MgO material to a content of the blue pigment ranges from 0.0083 to 10.

15. The plasma display panel of claim 11, wherein at least one of particles of the phosphor material is exposed on a surface of the phosphor layer in a direction toward the discharge cell.

16. A plasma display apparatus comprising:

a front substrate including a scan electrode and a sustain electrode positioned parallel to each other;

an upper dielectric layer positioned on the scan electrode and the sustain electrode, the upper dielectric layer including a glass-based material and a blue pigment;

a rear substrate on which an address electrode is positioned to intersect the scan electrode and the sustain electrode;

a lower dielectric layer positioned on the address electrode;

a barrier rib positioned between the front substrate and the rear substrate and that partitions a discharge cell; and a phosphor layer positioned inside the discharge cell, the phosphor layer including a phosphor material and magnesium oxide (MgO) material, wherein a first sustain signal is supplied to the scan electrode and a second sustain signal overlapping the first sustain signal is supplied to the sustain electrode during a sustain period of at least one subfield of a frame, wherein the magnesium oxide (MgO) material is (111), (222), (444)-oriented MgO materials to suppress a degradation of the phosphor layer and to reduce discharge delay time, wherein the upper dielectric layer includes a convex portion and a concave portion having a thickness less than a thickness of the convex portion, and the concave portion is positioned between the scan electrode and the sustain electrode, and wherein the concave portion partially overlaps the scan electrode and the sustain electrode.

17. The plasma display apparatus of claim 16, wherein the first sustain signal and the second sustain signal each include a voltage rising period, a first voltage maintenance period during which the first and second sustain signals are maintained at a highest voltage, a voltage falling period, and a second voltage maintenance period during which the first and second sustain signals are maintained at a lowest voltage, and the voltage falling period of the first sustain signal overlaps the voltage rising period of the second sustain signal.

18. The plasma display apparatus of claim 16, wherein the first sustain signal and the second sustain signal each include a voltage rising period, a first voltage maintenance period during which the first and second sustain signals are maintained at a highest voltage, a voltage falling period, and a second voltage maintenance period during which the first and second sustain signals are maintained at a lowest voltage, and a voltage difference between the scan electrode and the sustain electrode increases during the voltage falling periods of the first and second sustain signals.

19. The plasma display apparatus of claim 16, wherein the first sustain signal and the second sustain signal each include a voltage rising period, a first voltage maintenance period during which the first and second sustain signals are maintained at a highest voltage, a voltage falling period, and a second voltage maintenance period during which the first and second sustain signals are maintained at a lowest voltage, and a time width of the first voltage maintenance period of each of the first and second sustain signals is longer than a time width of the second voltage maintenance period of each of the first and second sustain signals.

20. The plasma display apparatus of claim 16, wherein an address bias signal maintained at a voltage level higher than a ground level voltage is supplied to the address electrode during the sustain period.

* * * * *